US005724952A

United States Patent [19]

Miyashita et al.

[11] Patent Number: 5,724,952

[45] Date of Patent: Mar. 10, 1998

[54] AIR-FUEL RATIO CONTROL SYSTEM FOR INTERNAL COMBUSTION ENGINES

[75] Inventors: Kotaro Miyashita; Hirofumi Mutoh; Katsushi Watanabe; Yukio Noda; Fumio Hara, all of Wako, Japan

[73] Assignee: Honda Giken Kogyo Kabushiki Kaisha, Tokyo, Japan

[21] Appl. No.: 660,390

[22] Filed: Jun. 7, 1996

[30] Foreign Application Priority Data

Jun. 9, 1995 [JP] Japan ..... 7-168073
Jun. 9, 1995 [JP] Japan ..... 7-168075
Jun. 9, 1995 [JP] Japan ..... 7-168076

[51] Int. Cl.[6] ..... F02D 41/14; F01N 3/20

[52] U.S. Cl. ..... 123/688; 123/696; 60/277

[58] Field of Search ..... 123/688, 690, 123/696; 60/276, 277, 285

[56] References Cited

U.S. PATENT DOCUMENTS 4,915,081 4/1990 Fujimoto et al. ..... 123/688
5,058,556 10/1991 Fukuma et al. ..... 123/688
5,065,728 11/1991 Nakaniwa ..... 123/688
5,179,929 1/1993 Miyashita et al. ..... 123/688
5,216,882 6/1993 Kuroda et al. ..... 123/688
5,370,101 12/1994 Hamburg et al. ..... 123/688
5,542,248 8/1996 Iwata et al. ..... 60/276
5,568,725 10/1996 Uchikawa ..... 123/688
5,640,847 6/1997 Nakajima et al. ..... 60/276

FOREIGN PATENT DOCUMENTS 60-192847 10/1985 Japan .

*Primary Examiner*—Willis R. Wolfe
*Attorney, Agent, or Firm*—Nikaido, Marmelstein, Murray & Oram LLP

[57] ABSTRACT

There is provided an air-fuel ratio control system for an internal combustion engine. The air-fuel ratio control system has an air-fuel ratio sensor arranged in an exhaust passage of the engine, which generates an output proportional to concentration of oxygen in exhaust gases emitted from the engine. The air-fuel ratio of a mixture supplied to the engine is controlled to a desired air-fuel ratio in response to the output from the air-fuel ratio sensor by the use of a proportional term and an integral term. A repetition period of inversion of the output from the air-fuel ratio sensor with respect to a predetermined reference value is calculated. Deterioration of the air-fuel ratio sensor is detected based the repetition period of inversion of the output from the air-fuel ratio sensor.

15 Claims, 21 Drawing Sheets

ECU5
ECU
IG
TW
PBA
TA
θTH
PA
LAF
O2
ECU5
ECU5
ECU5
ECU5
ECU5
ECU5
1
2
3
4
5
6
7
8
9
10
11
12
13
14
15
16
17
18
19
20
21
22
23
30
31
32
33
40
41
42
43
44
45
46
60

C
S725
KACT INVERTED WITH RESPECT TO KCMRP ?
YES
NO
S726
KACT > KCMRP ?
YES
NO
S729
FAFRPMC←1
S732
NITDC=0 ?
NO
YES
S733
FAFRPM=1 ?
NO
YES
S734
KLAF(k)← KLAF(k)+IRPM
S727
FAFRPM←0
S730
FAFRPM←1
S735
KLAF(k)← KLAF(k)−IRPM
S728
KLAF(k)← KLAF(k)+PRRPM
S731
KLAF(k)← KLAF(k)−PLPRM
NITDC← NIRPM
S736
NITDC← NITDC−1
S737
S738
KLAF(k) > KLAFLMTH ?
YES
NO
S739
KLAF(k) < KLAFLMTL ?
YES
NO
S740
KLAF(k)= KLAFLMTL
S741
KLAF(k)= KLAFLMTH
D

FIG.7A FLFRPM

FIG.7B KCMRPH KCMRPL

FIG.7C FAFRPM

FIG.7D KLAF

FIG.7E NWAVE

RESPONSE DETERIORATION DETERMINATION
S551
FLFRPEND=1 ?
YES
NO
S552
FLFMCHK=1 ?
NO
YES
S553
FLFRPMS=1 ?
NO
YES
S554
FLFRPM←0
FAFRPMC←0
S555
FAFRPMC=1 ?
NO
YES
S556
FAFRPMC←0
S557
FLFRPM←1
S558
FLFRPM=1 HELD IN LAST LOOP ?
NO
YES
S559
NWAVE←0
S561
NWAVE←NWAVE+1
S562
tmWAVE> TMWAVE ?
NO
YES
tmWAVE←0
S560
S563
tmCYCL← tmWAVE / NWAVE
S564
tmCYCL< tmCYCLOK ?
NO
YES
S565
FLFRPNG←1
S566
FLFRPEND←1
S567
FLFRPM←0
RETURN

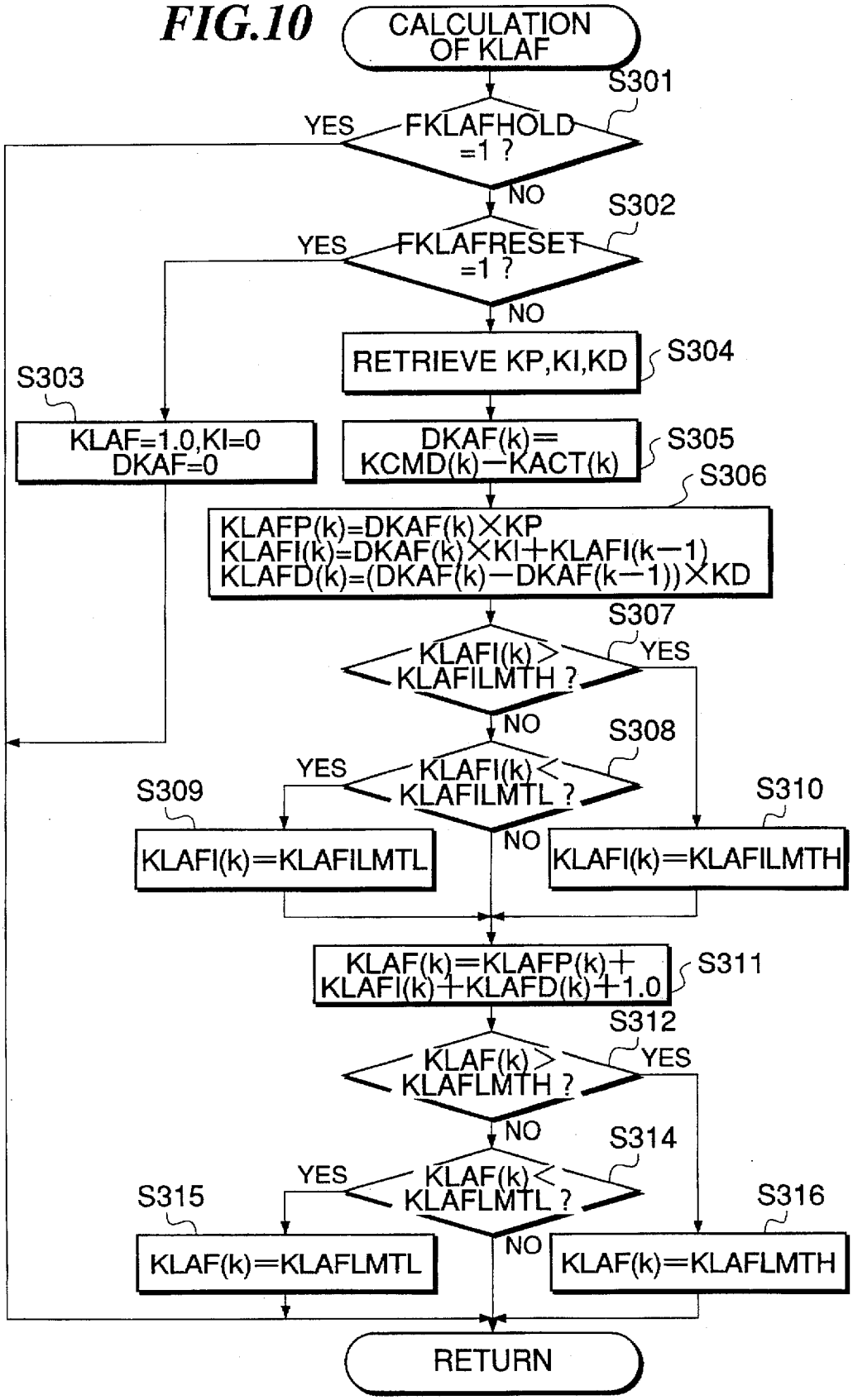
FIG.10
CALCULATION OF KLAF
S301
FKLAFHOLD =1 ?
YES
NO
S302
FKLAFRESET =1 ?
YES
NO
S303
KLAF=1.0,KI=0
DKAF=0
RETRIEVE KP,KI,KD
S304
DKAF(k)= KCMD(k)−KACT(k)
S305
S306
KLAFP(k)=DKAF(k)×KP
KLAFI(k)=DKAF(k)×KI+KLAFI(k−1)
KLAFD(k)=(DKAF(k)−DKAF(k−1))×KD
S307
KLAFI(k) > KLAFILMTH ?
YES
NO
S308
KLAFI(k) < KLAFILMTL ?
YES
NO
S309
KLAFI(k)=KLAFILMTL
S310
KLAFI(k)=KLAFILMTH
KLAF(k)=KLAFP(k)+ KLAFI(k)+KLAFD(k)+1.0
S311
S312
KLAF(k) > KLAFLMTH ?
YES
NO
S314
KLAF(k) < KLAFLMTL ?
YES
NO
S315
KLAF(k)=KLAFLMTL
S316
KLAF(k)=KLAFLMTH
RETURN

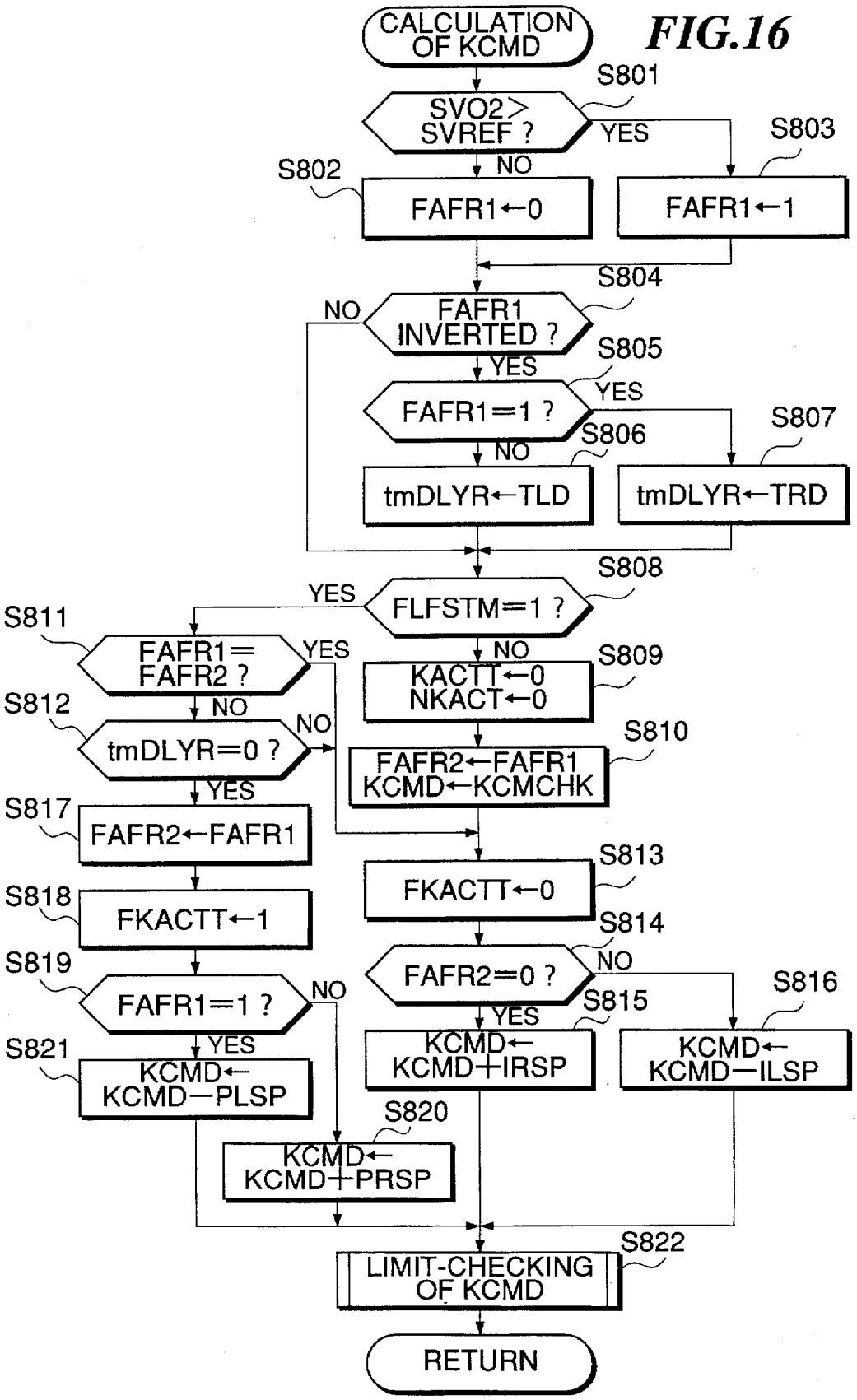
FIG.16
CALCULATION OF KCMD
S801
SVO2 > SVREF ?
YES
NO
S802
FAFR1←0
S803
FAFR1←1
S804
FAFR1 INVERTED ?
NO
YES
S805
FAFR1=1 ?
YES
NO
S806
tmDLYR←TLD
S807
tmDLYR←TRD
S808
FLFSTM=1 ?
YES
NO
S809
KACTT←0
NKACT←0
S810
FAFR2←FAFR1
KCMD←KCMCHK
S811
FAFR1= FAFR2 ?
YES
NO
S812
tmDLYR=0 ?
NO
YES
S817
FAFR2←FAFR1
S818
FKACTT←1
S819
FAFR1=1 ?
NO
YES
S821
KCMD← KCMD−PLSP
S820
KCMD← KCMD+PRSP
S813
FKACTT←0
S814
FAFR2=0 ?
NO
YES
S815
KCMD← KCMD+IRSP
S816
KCMD← KCMD−ILSP
S822
LIMIT-CHECKING OF KCMD
RETURN

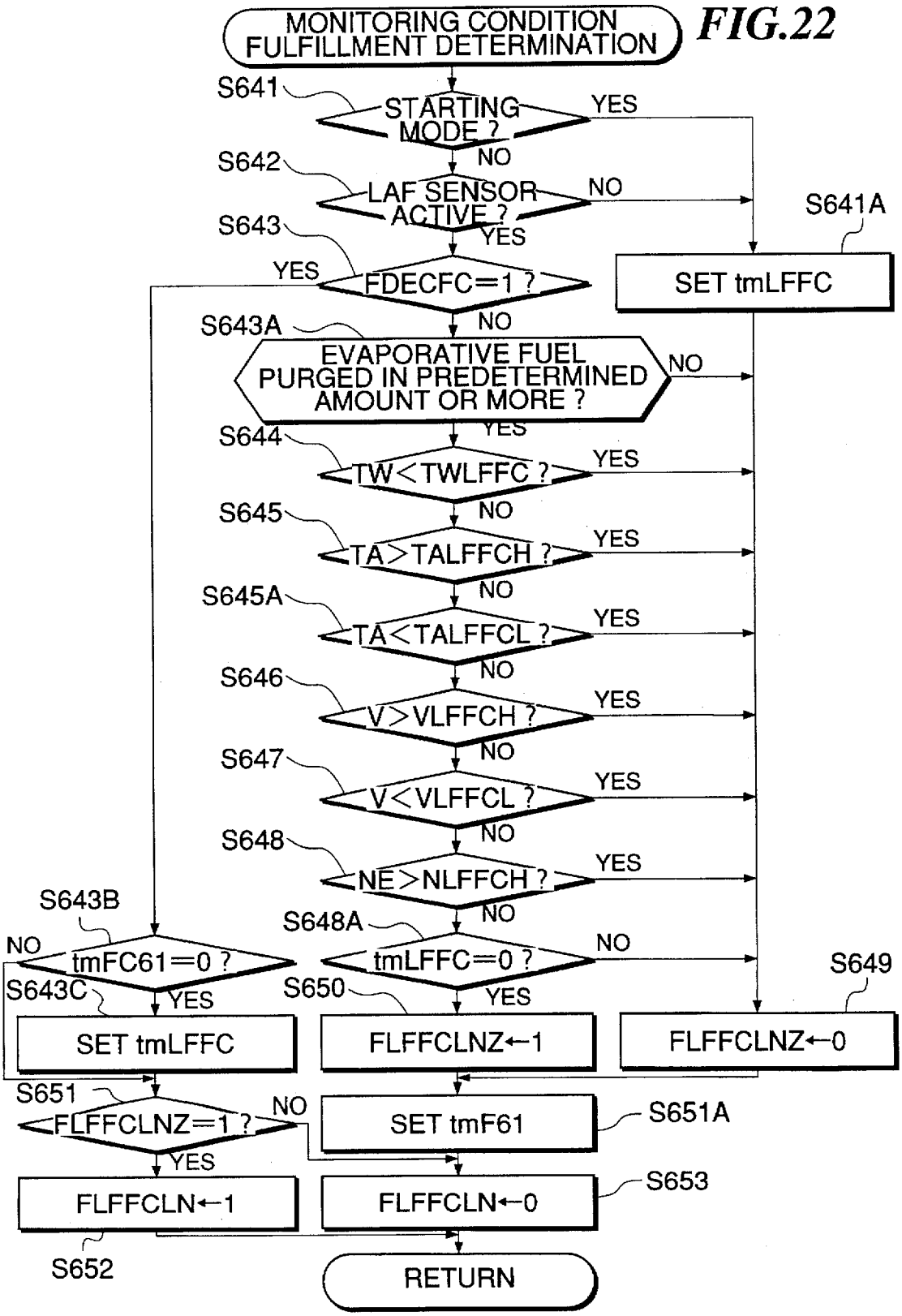
MONITORING CONDITION FULFILLMENT DETERMINATION
FIG.22
S641
STARTING MODE ?
YES
NO
S642
LAF SENSOR ACTIVE ?
NO
YES
S641A
SET tmLFFC
S643
FDECFC=1 ?
YES
NO
S643A
EVAPORATIVE FUEL PURGED IN PREDETERMINED AMOUNT OR MORE ?
NO
YES
S644
TW<TWLFFC ?
YES
NO
S645
TA>TALFFCH ?
YES
NO
S645A
TA<TALFFCL ?
YES
NO
S646
V>VLFFCH ?
YES
NO
S647
V<VLFFCL ?
YES
NO
S648
NE>NLFFCH ?
YES
NO
S643B
tmFC61=0 ?
NO
YES
S643C
SET tmLFFC
S648A
tmLFFC=0 ?
NO
YES
S650
FLFFCLNZ←1
S649
FLFFCLNZ←0
S651
FLFFCLNZ=1 ?
NO
YES
SET tmF61
S651A
FLFFCLN←1
S652
FLFFCLN←0
S653
RETURN

AIR-FUEL RATIO CONTROL SYSTEM FOR INTERNAL COMBUSTION ENGINES

BACKGROUND OF THE INVENTION

1. Field of the Invention

This invention relates to an air-fuel ratio control system for internal combustion engines, which controls the air-fuel ratio of a mixture supplied to the engine to a desired air-fuel ratio in a feedback manner based on an output from an air-fuel ratio sensor arranged in the exhaust system of the engine, and more particularly to an air-fuel ratio control system of this kind which has a function of detecting deterioration of a linear output air-fuel ratio sensor used as the air-fuel ratio sensor.

2. Prior Art

Conventionally, it is widely known to provide a linear output air-fuel ratio sensor (hereinafter referred to as "LAF sensor") in the exhaust system of an internal combustion engine, and control the air-fuel ratio of a mixture supplied to the engine in a feedback manner by the use of feedback control amounts, such as a proportional term and an integral term, calculated based on an output from the LAF sensor.

However, an air-fuel ratio control system using this technique is incapable of notifying the driver of deterioration of a response characteristic of the LAF sensor, which can be caused by a clogged protector provided for the sensor, at an early stage of the deterioration in a reliable manner. Due to the deteriorated response characteristic of the LAF sensor, the air-fuel ratio of the mixture supplied to the engine (hereinafter referred to as "the supply air-fuel ratio") is not properly controlled, causing exhaust emission characteristics of the engine and the driveability thereof to be degraded before the driver becomes aware of such an actual faulty condition of the LAF sensor.

It is also known to detect failure of a LAF sensor, which is employed as an air-fuel ratio sensor, from an increase in the internal resistance of a sensor element thereof. This method involves measuring a voltage across electrodes of the sensor element when transfer of oxygen ions occurs, and determining that the internal resistance of the sensor element has increased beyond a tolerance limit if the measured voltage becomes higher than a predetermined value.

However, the conventional method cannot detect a change or deterioration in output characteristics of the LAF sensor. If the LAF sensor has its output characteristics changed e.g. due to foreign matter attached thereto, the air-fuel ratio of exhaust gases deviates from a stoichiometric air-fuel ratio when the former should be controlled to the latter to obtain the maximum purifying efficiency of a three-way catalyst arranged in the exhaust system. In such a case, the three-way catalyst cannot purify noxious components contained in the exhaust gases to its best purifying degree.

Further, a device for detecting deterioration of a LAF sensor as an air-fuel ratio sensor for an internal combustion engine has been proposed by Japanese Laid-Open Patent Publication (Kokai) No. 60-192847, which applies a predetermined voltage to the LAF sensor when a predetermined time period has elapsed after interruption of fuel supply to the engine (fuel cut) was started, and then compares an output from the LAF sensor with a predetermined reference value to determine deterioration of the LAF sensor.

The proposed device thus starts checking of the LAF sensor for deterioration when the predetermined time period has elapsed after the fuel cut was started. Depending on operating conditions of the engine, however, the output from the LAF sensor cannot always become stabilized even after the predetermined time period has elapsed. In such a case, the proposed device is incapable of properly detecting deterioration of the LAF sensor with accuracy.

SUMMARY OF THE INVENTION

It is a first object of the invention to provide an air-fuel ratio control system for an internal combustion engine, which is capable of easily and accurately detecting deterioration of a response characteristic of an air-fuel ratio sensor used in the air-fuel ratio control system.

It is a second object of the invention to provide an air-fuel ratio control system for an internal combustion engine, which is capable of detecting a change in an output characteristic of an air-fuel ratio sensor used in the air-fuel ratio control system, and properly controlling the air-fuel ratio of exhaust gases to a stoichiometric air-fuel ratio to thereby secure the optimum purifying efficiency of a catalyst arranged in the exhaust system of the engine for purifying noxious components contained in exhaust gases.

It is a third object of the invention to provide an air-fuel ratio control system for an internal combustion engine, which is capable of enhancing the accuracy of detecting deterioration of an air-fuel ratio sensor used in the air-fuel ratio control system.

To attain the first object, according to a first aspect of the present invention, there is provided an air-fuel ratio control system for an internal combustion engine having an exhaust passage, comprising:

- air-fuel ratio-detecting means arranged in the exhaust passage, for generating an output proportional to concentration of oxygen in exhaust gases emitted from the engine;
- air-fuel ratio feedback control means for controlling an air-fuel ratio of a mixture supplied to the engine to a desired air-fuel ratio in response to the output from the air-fuel ratio-detecting means by the use of a proportional term and an integral term;
- inversion period-calculating means for calculating a repetition period of inversion of the output from the air-fuel ratio-detecting means with respect to a predetermined reference value; and
- deterioration-detecting means for detecting deterioration of the air-fuel ratio-detecting means, based the repetition period of inversion of the output from the air-fuel ratio-detecting means calculated by the inversion period-calculating means.

Preferably, the predetermined reference value is provided with hysteresis.

Preferably, the air-fuel ratio feedback control means controls the air-fuel ratio of the mixture in a feedback manner responsive to the output from the air-fuel ratio-detecting means by the use of the proportional term, the integral term and a differential term, when the engine is outside a predetermined operating condition suitable for determination of deterioration of the air-fuel ratio-detecting means, and controls the air-fuel ratio of the mixture in a feedback manner responsive to the output from the air-fuel ratio-detecting means by the use of the proportional term and the integral term when the engine is in the predetermined operating condition suitable for determination of deterioration of the air-fuel ratio-detecting means.

Specifically, the deterioration-detecting means determines that the air-fuel ratio-detecting means is deteriorated in response characteristic when the repetition period of inversion exceeds a predetermined value.

To attain the second object, according to a second aspect of the invention, there is provided an air-fuel ratio control system for an internal combustion engine having an exhaust passage, the air-fuel ratio control system including a catalyst arranged in the exhaust passage, first air-fuel ratio-detecting means arranged in the exhaust passage at a location upstream of the catalyst, for generating an output proportional to concentration of oxygen in exhaust gases emitted from the engine, and second air-fuel ratio-detecting means arranged in the exhaust passage at a location downstream of the catalyst, for generating an output which assumes a lean value or a rich value with respect to a stoichiometric air-fuel ratio according to an air-fuel ratio of the exhaust gases.

The air-fuel ratio control system according to the second aspect of the invention is characterized by comprising:

desired air-fuel ratio-calculating means for calculating a desired air-fuel ratio by the use of a proportional term and an integral term in response to the output from the second air-fuel ratio-detecting means;

air-fuel ratio control means for controlling an air-fuel ratio of a mixture supplied to the engine to the desired air-fuel ratio calculated by the desired air-fuel ratio-calculating means in a feedback manner responsive to the output from the first air-fuel ratio-detecting means; and deterioration-detecting means for detecting deterioration of the first air-fuel ratio-detecting means, based on an average value of the output from the first air-fuel ratio-detecting means.

Preferably, the deterioration-detecting means includes average value-calculating means for calculating the average value of the output from the first air-fuel ratio-detecting means by averaging a predetermined number of values of the output from the first air-fuel ratio-detecting means consecutively generated whenever the output from the second air-fuel ratio control means is inverted with respect to the stoichiometric air-fuel ratio, the deterioration-detecting means determining that the first air-fuel ratio-detecting means is deteriorated when the average value is outside a predetermined value range.

Preferably, the air-fuel ratio control system includes correcting means for correcting the output from the first air-fuel ratio-detecting means, based on the average value of the output from the first air-fuel ratio-detecting means.

More preferably, the correcting means determines a difference between the average value of the output from the first air-fuel ratio-detecting means and the stoichiometric air-fuel ratio and corrects the output from the first air-fuel ratio-detecting means, based on the difference.

Preferably, the desired air-fuel ratio-calculating means applies the integral term in calculating the desired air-fuel ratio such that the air-fuel ratio of the mixture is enriched when the output from the second air-fuel ratio-detecting means is on a leaner side with respect to the stoichiometric air-fuel ratio, and the air-fuel ratio of the mixture is leaned when the output from the second air-fuel ratio is on a richer side with respect to the stoichiometric air-fuel ratio.

Preferably, the air-fuel ratio control means controls the air-fuel ratio of the mixture in the feedback manner responsive to the output from the first air-fuel ratio-detecting means by the use of a proportional term, an integral term and a differential term.

To attain the third object, according to a third aspect of the invention, there is provided an air-fuel ratio control system for an internal combustion engine installed on an automotive vehicle and having an exhaust passage, the air-fuel ratio control system including air-fuel ratio-detecting means arranged in the exhaust passage for generating an output which is proportional to concentration of oxygen in exhaust gases emitted from the engine, and fuel amount control means for controlling an amount of fuel supplied to the engine, based on the output from the air-fuel ratio-detecting means.

The air-fuel ratio control system according to the third aspect of the invention is characterized by comprising:

fuel supply-interrupting means for interrupting supply of fuel to the engine when the automotive vehicle and the engine are in respective predetermined operating conditions; and deterioration-detecting means for detecting deterioration of the air-fuel ratio-detecting means, based on the output from the air-fuel ratio-detecting means when a variation in the output from the air-fuel ratio-detecting means falls within a predetermined range after the supply of fuel to the engine is interrupted.

Preferably, the deterioration-detecting means detects the deterioration of the air-fuel ratio-detecting means, based on an value of the output from the air-fuel ratio-detecting means obtained when a predetermined time period has elapsed after the variation in the output from the air-fuel ratio-detecting means falls within the predetermined range.

Also preferably, the deterioration-detecting means detects the deterioration of the air-fuel ratio-detecting means, based on the output from the air-fuel ratio-detecting means when the output from the air-fuel ratio-detecting means falls below a predetermined value and at the same time the variation in the output from the air-fuel ratio-detecting means falls within the predetermined range, after the supply of fuel to the engine is interrupted.

Preferably, the air-fuel ratio control system includes average value-calculating means for calculating an average value of the output from the air-fuel ratio-detecting means, and the deterioration-detecting means determines that the air-fuel ratio-detecting means is deteriorated when the average value of the output from the air-fuel ratio-detecting means falls outside a predetermined range.

The above and other objects, features, and advantages of the invention will become more apparent from the following detailed description taken in conjunction with the accompanying drawings.

BRIEF DESCRIPTION OF THE DRAWINGS

FIGS. 7A to 7E collectively form a timing chart which is useful in explaining how deterioration of a response characteristic (response deterioration) of the LAF sensor is determined, in which:

FIG. 7A shows changes in a response deterioration determination execution flag FLFRPM;

FIG. 7B shows changes in an actual equivalent ratio KACT across inversion-determining reference values KCMRPH, KCMRPL;

FIG. 7C shows changes in an inversion flag FAFRPM;

FIG. 7D shows changes in the PID correction coefficient KLAF; and

FIG. 7E shows changes in the count NWAVE of an NWAVE counter;

FIG. 10 is a flowchart showing a routine for calculating the PID correction coefficient KLAF, which is executed at the step S10 in FIG. 2 by an air-fuel ratio control system according to a second embodiment of the invention;

FIGS. 13A to 13C collectively form a timing chart which is useful in explaining how the stoichiometric output deterioration of the LAF sensor is determined, in which:

FIG. 13A shows changes in a stoichiometric output deterioration determination execution flag FLFSTM;

FIG. 13B shows changes in an O2 sensor output SVO2; and

FIG. 13C shows changes in a desired equivalent ratio KCMD;

FIG. 16 is a flowchart showing a subroutine for calculating the desired equivalent ratio KCMD during determination of the stoichiometric output deterioration of the LAF sensor, which is executed at a step S527 in FIG. 11;

FIGS. 20A to 20C collectively form a timing chart which is useful in explaining how the lean output deterioration of the LAF sensor is determined, in which:

FIG. 20A shows a change in a lean output deterioration-determining region flag FLFFCLNZ;

FIG. 20B shows a change in a lean output deterioration determination-enabling flag FLFFCLN; and FIG. 20C shows changes in the LAF sensor output RVIP;

FIG. 22 is a flowchart showing a background routine for determining whether or not monitoring conditions, i.e. conditions for determining the lean output deterioration of the LAF sensor are fulfilled.

DETAILED DESCRIPTION

The invention will now be described in detail with reference to the drawings showing embodiments thereof.

Figure 1:
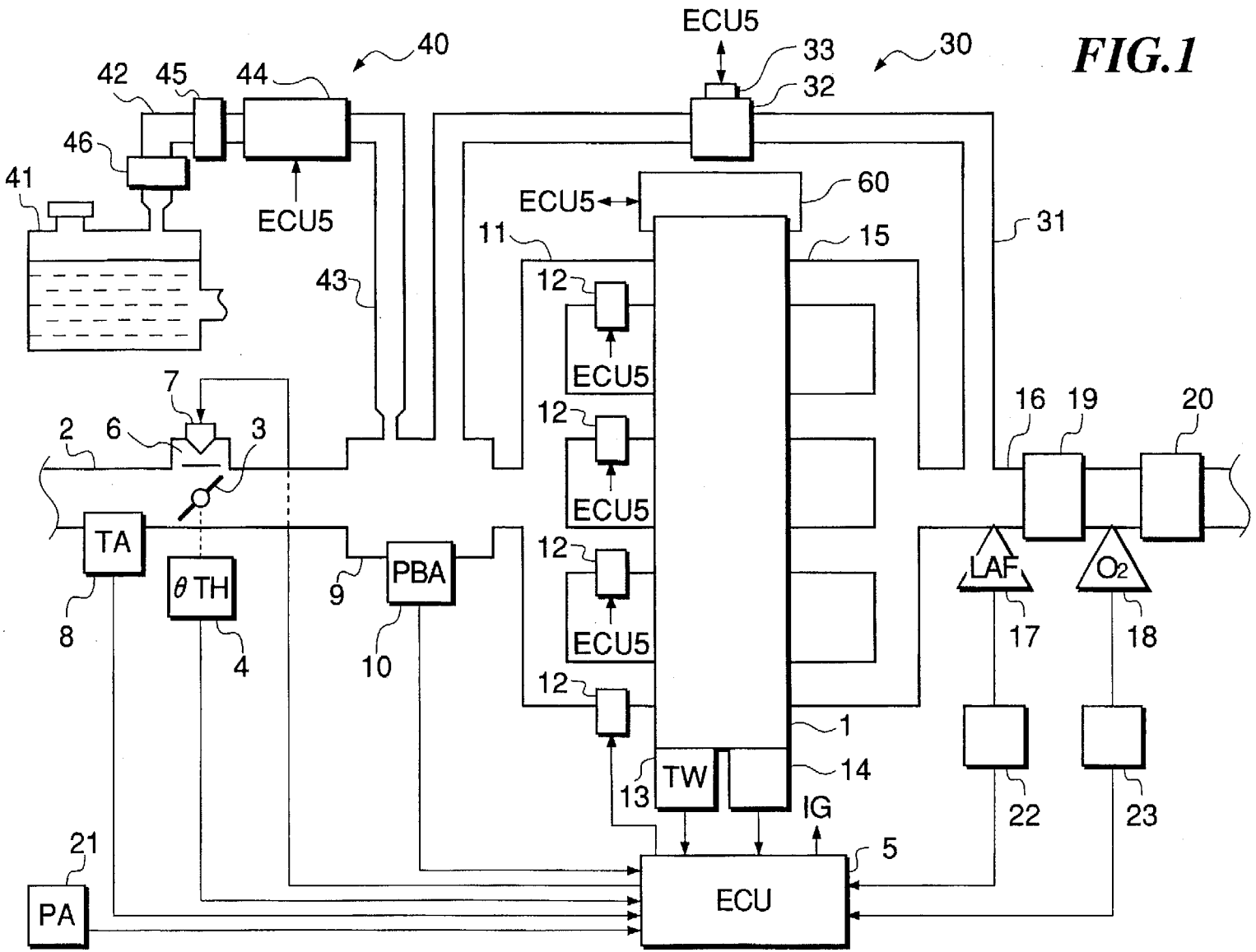
FIG. 1 is a block diagram showing the arrangement of an internal combustion engine incorporating an air-fuel ratio control system therefore, according to a first embodiment of the invention.

Referring first to FIG. 1, there is shown the whole arrangement of a DOHC straight type four-cylinder internal combustion engine (hereinafter simply referred to as "the engine"), and an air-fuel ratio control system therefore, according to a first embodiment of the invention. In the figure, reference numeral 1 designates an internal combustion engine for automotive vehicles.

The engine 1 has an intake pipe 2 having a manifold part (intake manifold) 11 directly connected to the combustion chamber of each cylinder. A throttle valve 3 is arranged in the intake pipe 2 at a location upstream of the manifold part 11. A throttle valve opening (θTH) sensor 4 is connected to the throttle valve 3 for generating an electric signal indicative of the sensed throttle valve opening θTH and supplying the same to an electronic control unit (hereinafter referred to as "the ECU") 5. The intake pipe 2 is provided with an auxiliary air passage 6 bypassing the throttle valve 3, and an auxiliary air amount control valve (electromagnetic valve) 7 is arranged in the auxiliary air passage 6. The auxiliary air amount control valve 7 is connected to the ECU 5 to have an amount of opening thereof controlled by a signal therefrom.

An intake air temperature (TA) sensor 8 is inserted into the intake pipe 2 at a location upstream of the throttle valve 3 for supplying an electric signal indicative of the sensed intake air temperature TA to the ECU 5. The intake pipe 2 has a thickened portion 9 as a chamber interposed between the throttle valve 3 and the intake manifold 11. An intake pipe absolute pressure (PBA) sensor 10 is arranged in the chamber 9 for supplying a signal indicative of the sensed intake pipe absolute pressure PBA to the ECU 5.

An engine coolant temperature (TW) sensor 13, which may be formed of a thermistor or the like, is mounted in the cylinder block of the engine 1 filled with an engine coolant, for supplying an electric signal indicative of the sensed engine coolant temperature TW to the ECU 5. A crank angle position sensor 14 for detecting the rotational angle of a crankshaft, not shown, of the engine 1 is connected to the ECU 5 for supplying signals corresponding to the rotational angle of the crankshaft to the ECU 5. The crank angle position sensor 14 is comprised of a cylinder-discriminating sensor which generates a pulse (hereinafter referred to as "the CYL signal pulse") at a predetermined crank angle position of a particular cylinder of the engine a predetermined angle before a TDC position of the cylinder corresponding to the start of the intake stroke thereof, a TDC sensor which generates a pulse (hereinafter referred to as "the TDC signal pulse") at a predetermined crank angle position of each cylinder a predetermined angle before the TDC position of the cylinder corresponding to the start of the intake stroke thereof (whenever the crankshaft rotates through 180 degrees in the case of a four-cylinder engine), and a CRK sensor which generates a pulse (hereinafter referred to as "the CRK signal pulse) at each of predetermined crank angle positions whenever the crankshaft rotates through a predetermined angle (e.g. 30 degrees) smaller than the rotational angle interval of generation of the TDC signal pulse. The CYL signal pulse, the TDC signal pulse and the CRK signal pulse are supplied to the ECU 5. These signal pulses are used for timing control in carrying out operations of the air-fuel ratio control system and other control systems of the engine for determining fuel injection timing, ignition timing, etc., as well as for detecting the engine rotational speed NE.

Fuel injection valves 12 are inserted into the intake manifold 11 at locations slightly upstream of respective corresponding intake valves, not shown, of the respective cylinders. The fuel injection valves 12 are connected to a fuel pump, not shown, and electrically connected to the ECU 5 to have their valve opening periods (fuel injection periods) and fuel injection timing controlled by signals therefrom. The engine 1 has spark plugs, not shown, provided for respective cylinders and electrically connected to the ECU 5 to have ignition timing θIG thereof controlled by signals therefrom.

An exhaust pipe 16 of the engine has a manifold part (exhaust manifold) 15 directly connected to the combustion chambers of the cylinders of the engine 1. A linear output air-fuel ratio sensor (hereinafter referred to as "the LAF sensor") 17 is arranged in a confluent portion of the exhaust pipe 16 at a location immediately downstream of the exhaust manifold 15. Further, an immediate downstream three-way catalyst 19 and a bed-downstream three-way catalyst 20 are arranged in the confluent portion of the exhaust pipe 16 at respective locations downstream of the LAF sensor 17 for purifying noxious components, such as HC, CO, and NOx. An oxygen concentration sensor (hereinafter referred to as "the O2 sensor") 18 is arranged between the three-way catalysts 19 and 20.

The LAF sensor 17 is connected via a low-pass filter 22 to the ECU 5 for supplying the ECU 5 with an electric signal substantially proportional in value to the concentration of oxygen present in exhaust gases from the engine (i.e. the air-fuel ratio). The O2 sensor 18 has an output characteristic that output voltage thereof drastically changes when the air-fuel ratio of a mixture supplied to the engine changes across a stoichiometric air-fuel ratio to deliver a high level signal when the mixture is richer than the stoichiometric air-fuel ratio, and a low level signal when the mixture is leaner than the same. The O2 sensor 18 is connected via a low-pass filter 23 to the ECU 5 for supplying the ECU 5 with the high or low level signal.

The engine 1 is also provided with an exhaust gas recirculation system (EGR system) 30 which is comprised of an exhaust gas recirculation passage 31 connecting between the chamber 9 of the intake pipe 2 and the exhaust pipe 16, an exhaust gas recirculation (EGR) control valve 32 arranged in the exhaust gas recirculation passage 31 for controlling the amount of recirculated exhaust gases, and a lift sensor 33 for detecting the opening of the EGR control valve 32 and supplying a signal indicative of the sensed opening of the EGR control valve to the ECU 5. The EGR control valve 32 is formed by an electromagnetic valve having a solenoid which is connected to the ECU 5 to have its valve opening linearly changed by a control signal from the ECU 5.

The engine 1 is further provided with an evaporative emission control system 40. The evaporative emission control system 40 is comprised of a fuel tank 41, a canister 45, a passage 42 connecting between the fuel tank 41 and the canister 45, and a purging passage 43 connecting between the canister 45 and the chamber 9 of the intake pipe 2. The canister 45 contains an adsorbent for adsorbing evaporative fuel generated from the fuel tank 41 and is provided with an air inlet port, not shown, via which fresh air is introduced into the canister 45. A two-way valve 46 having a positive pressure valve and a negative pressure valve, neither of which is shown, is arranged in the passage 42, while a purge control valve 44 formed by an electromagnetic valve of a duty control type is arranged in the purging passage 43. The purge control valve 44 has its valve opening controlled by a control signal from the ECU 5.

An atmospheric pressure (PA) sensor 21 is electrically connected to the ECU 5 for detecting atmospheric pressure PA, and supplying a signal indicative of the sensed atmospheric pressure PA to the ECU 5.

The ECU 5 is comprised of an input circuit having the functions of shaping the waveforms of input signals from various sensors, shifting the voltage levels of sensor output signals to a predetermined level, converting analog signals from analog-output sensors to digital signals, and so forth, a central processing unit (hereinafter referred to as "the CPU"), a memory device comprised of a ROM storing various operational programs which are executed by the CPU and various maps, referred to hereinafter, and a RAM for storing results of calculations from the CPU, etc., and an output circuit which outputs driving signals to the fuel injection valves 12 and other electromagnetic valves, the spark plugs, etc.

The ECU 5 operates in response to the above-mentioned signals from the sensors including the LAF sensor 17 and the O2 sensor 18 to determine various operating conditions in which the engine 1 is operating, such as an air-fuel ratio feedback control region in which the air-fuel ratio is controlled in response to outputs from the LAF sensor 17 and the O2 sensor 18, and open-loop control regions other than these regions, and calculates, based upon the determined operating conditions, the valve opening period or fuel injection period TOUT over which the fuel injection valves 12 are to be opened, by the use of the following equation (1) in synchronism with inputting of TDC signal pulses to the ECU 5, to deliver driving signals to the fuel injection valves 12, which are based on results of the calculation:

$$TOUT(N)=TIMF\times KTOTAL\times KCMDM\times KLAF \quad (1)$$

where the suffix (N) represents a cylinder number, and a parameter with this suffix is calculated cylinder by cylinder. It should be noted that in the present embodiment, the amount of fuel to be supplied to the engine is calculated, actually, in terms of a time period over which the fuel injection valve 6 is opened (fuel injection period), but in the present specification, the fuel injection period TOUT is also referred to as the fuel injection amount or the fuel amount since the fuel injection period is equivalent to the amount of fuel injected or to be injected.

TIMF represents a basic fuel amount corresponding to the amount of intake air, which is basically determined according to the engine rotational speed NE and the intake pipe absolute pressure PBA.

KTOTAL represents the product of all feedforward correction coefficients, such as an engine coolant temperature-dependent correction coefficient KTW set according to the engine coolant temperature TW, an EGR-dependent correction coefficient KEGR set according to the amount of recirculation of exhaust gases during execution of the exhaust gas recirculation, and a purge-dependent correction coefficient KPUG set according to the amount of purged fuel during execution of purging of evaporative fuel by the evaporative emission control system 40. KCMDM represents a final desired air-fuel ratio correction coefficient, and KLAF a PID correction coefficient determined in response to the output from the LAF sensor 17.

In the present embodiment, the above-mentioned functions of calculating the fuel injection period TOUT(N), etc., are realized by arithmetic operations executed by the CPU of the ECU 5, and details of the operations will be described with reference to program routines illustrated in the drawings.

Figure 2:
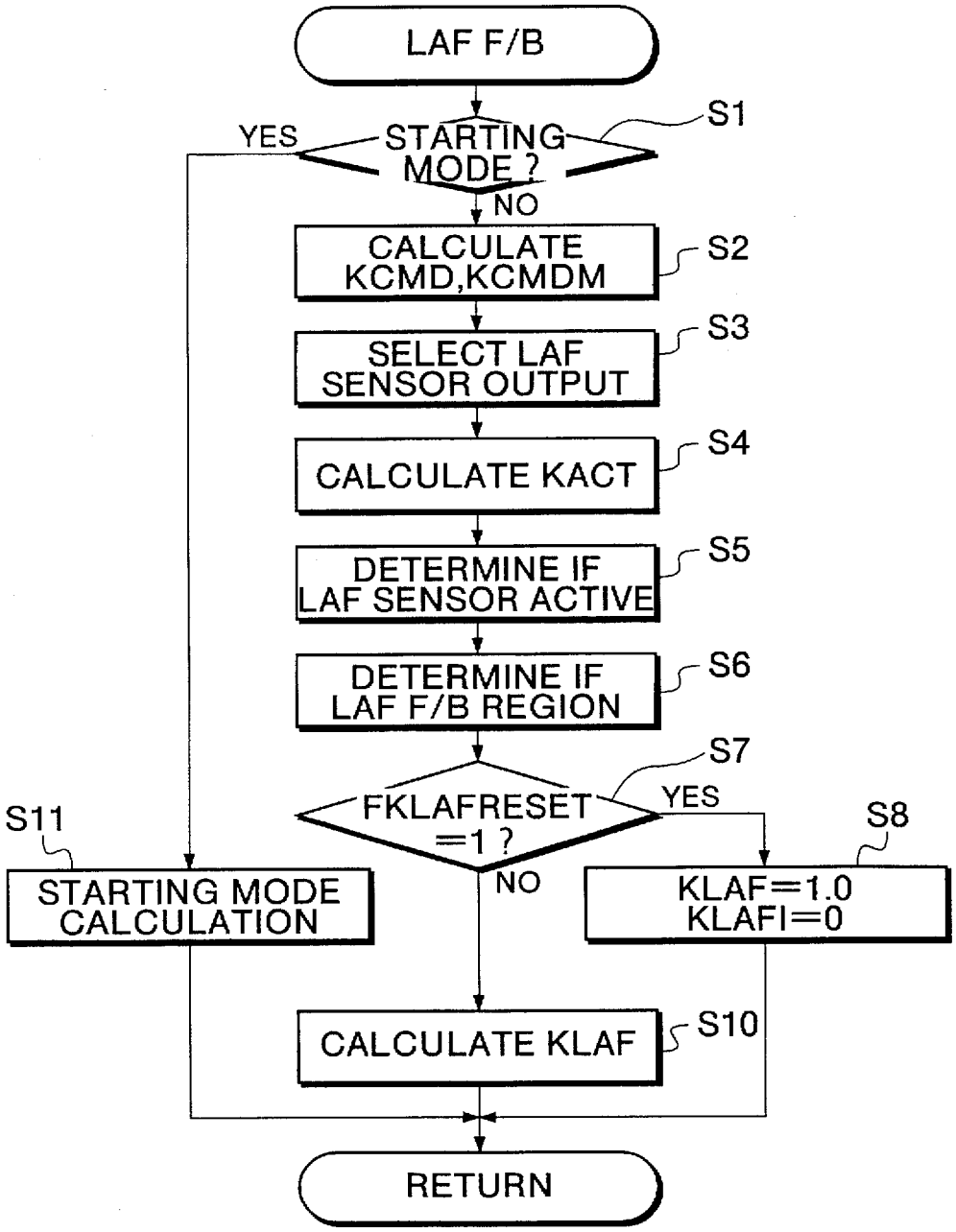
FIG. 2 is a flowchart showing a main routine for calculating an air-fuel ratio correction coefficient (PID correction coefficient) KLAF in response to an output from a LAF sensor appearing in FIG. 1.

FIG. 2 shows a main routine for calculating the PID correction coefficient KLAF in response to the output from the LAF sensor 17. This routine is executed in synchronism with generation of each TDC signal pulse.

At a step S1, it is determined whether or not the engine is in a starting mode, i.e. whether or not the engine is being cranked. If the engine is in the starting mode, the program proceeds to a step S11 to execute a subroutine for the starting mode. If the engine is not in the starting mode, a desired air-fuel ratio coefficient (desired equivalent ratio) KCMD and the final desired air-fuel ratio coefficient KCMDM are calculated at a step S2, and LAF sensor output-selecting processing is executed at a step S3. Further, an actual equivalent ratio KACT is calculated at a step S4. The actual equivalent ratio KACT is obtained by converting the output from the LAF sensor 17 to an equivalent ratio value.

Then, it is determined at a step S5 whether or not the LAF sensor 17 has been activated. This determination is carried out e.g. by comparing the difference between the output voltage from the LAF sensor 17 and a central voltage thereof with a predetermined value (e.g. 0.4 V), and determining that the LAF sensor 17 has been activated when the difference is smaller than the predetermined value.

Then, it is determined at a step S6 whether or not the engine 1 is in an operating region in which the air-fuel ratio feedback control responsive to the output from the LAF sensor 17 is to be carried out (hereinafter referred to as "the LAF feedback control region"). More specifically, it is determined that the engine 1 is in the LAF feedback control region, e.g. when the LAF sensor 17 has been activated but at the same time neither fuel cut nor wide open throttle operation is being carried out. If it is determined at this step that the engine is not in the LAF feedback control region, a KLAF reset flag FKLAFRESET is set to "1", whereas if it is determined that the engine is in the LAF feedback control region, the KLAF reset flag FKLAFRESET is set to "0".

At the following step S7, it is determined whether or not the KLAF reset flag FKLAFRESET assumes "1". If FKLAFRSET=1 holds, the program proceeds to a step S8, wherein the PID correction coefficient KLAF is set to "1.0", and an integral term KLAFI used in the PID feedback control is set to "0", followed by terminating the program.

On the other hand, if FKLAFRESET=0 holds at the step S7, the PID correction coefficient KLAF is calculated at a step S10, followed by terminating the program.

Next, a subroutine for executing the step S10 of the FIG. 2 routine to calculate the PID correction coefficient KLAF will be described with reference to FIGS. 3 to 5. This subroutine is executed in synchronism with generation of each TDC signal pulse.

First, at a step S701, the difference DKAF(k) between the desired equivalent ratio KCMD and the actual equivalent ratio KACT (=KCMD(k)−KACT(k)) is calculated, and then at a step S702, it is determined whether or not a monitoring condition flag FLFMCHK, which, when set to "1", indicates that the conditions for permitting determination of deterioration of a response characteristic (response deterioration) of the LAF sensor 17 and determination of deterioration of a stoichiometric output characteristic (stoichiometric output deterioration) of the same are fulfilled, assumes "1". If FLFMCHK=1 holds, it is determined at a step S703 whether or not a stoichiometric output deterioration determination termination flag FLFSTEND, which, when set to 1, indicates that the determination of the stoichiometric output deterioration of the LAF sensor 17 has been terminated, assumes "1". If FLFMCHK=0 holds at the step S702 or FLFSTEND=0 holds at the step S703, the program proceeds to steps S704 et seq., to calculate the PID correction coefficient KLAF by the use of a P-term (proportional term), an I-term (integral term), and a D-term (differential term). On the other hand, if FLFSTEND=1 holds at the step S703, the program proceeds to steps S721, et seq., to calculate the PID correction coefficient KLAF by the use of the P-term (proportional term) and the I-term (integral term) alone.

The calculation of the PID correction coefficient KLAF (PID feedback control) executed at the steps S704 et seq. will be described first. At the step S704, it is determined whether or not the count NITDC of an NITDC counter, which is set to a predetermined thinning variable NI, is equal to "0". If the count NITDC of the NITDC counter is not equal to 0, the NITDC counter is decremented by "1" at a step S705 to update the count NITDC of the NITDC counter, and the present value DKAF(k) of the difference DKAF is stored as the immediately preceding value DKAF(k−1) of the same at a step S706, followed by terminating the program.

On the other hand, if NITDC=0 holds at the step S704, the program proceeds to a step S707, wherein a proportional term control gain KP, an integral term control gain KI, and a differential term control gain KD are retrieved from respective maps according to the engine rotational speed NE and the intake pipe absolute pressure PBA, and the thinning variable NI is determined. Then, the difference DKAF(k) and the gains KP, KI, and KD calculated at the steps S701 and S707 are applied to the following equations (2) to (4) to calculate a proportional term KLAFP(k), an integral term KLAFI(k), and a differential term KLAFD(k) at a step S708:

$$KLAFP(k)=DKAF(k)\times KP \quad (2)$$

$$KLAFI(k)=DKAF(k)\times KI+KLAFI(k-1) \quad (3)$$

$$KLAFD(k)=(DKAF(k)-DKAF(k-1))\times KD \quad (4)$$

At the following steps S709 to S715, limit-checking of the calculated integral term KLAFI(k) is carried out. More specifically, lower and upper limit values KLAFILMTL, KLAFILMTH of a limit value KLAFILMT are calculated at a step S709, and then it is determined whether or not the KLAFI(k) value falls within a range defined by the upper and lower limit values KLAFILMTH and KLAFILMTL at steps S710 and S711. If KLAFI(k)>KLAFILMTH holds at the step S710, the integral term KLAFI(k) is set to the upper limit value KLAFILMTH at a step S713 and the PID correction coefficient KLAF(k) is set to the same at a step S715, whereas if KLAFI(k)<KLAFILIMTL holds at the step S711, the integral term KLAFI(k) is set to the lower limit value KLAFILMTL at a step S712 and the PID correction coefficient KLAF(k) is set to the same at a step S714.

If KLAFILMTL≦KLAFI(k)≦KLAFILMTH holds, the program proceeds to a step S716, wherein the PID correction coefficient KLAF(k) is calculated by the use of the following equation (5):

$$KLAF(k)=KLAFP(k)+KLAFI(k)+KLAFD(k) \quad (5)$$

At the following steps S717 to S721, limit-checking of the calculated PID correction coefficient KLAF(k) is executed by the use of a limit value KLAFLMT. More specifically, at the step S717, upper and lower limit values KLAFLMTH, KLAFLMTL of the limit value KLAFLMT are calculated, and then it is determined at a step S718 whether or not the KLAF(k) value is larger than the upper limit value KLAFLMTH. If KLAF(k)>KLAFLMTH holds, the PID correction coefficient KLAF(k) is set to the upper limit value KLAFLMTH at the step S721, whereas if KLAF(k) ≦KLAFLMTH holds at the step S718, it is determined at a step S719 whether or not the KLAF(k) value is smaller than the lower limit value KLAFLMTL. If KLAF(k) ≧KLAFLMTL holds, the program proceeds to a step S722, whereas if KLAF(k)<KLAFLMTL holds at the step S719, the PID correction coefficient KLAF(k) is set to the lower limit value KLAFLMTL at a step S720.

After executing the step S714, S715, S720 or S721, the program proceeds to the step S722, wherein the thinning variable NI is set to the NITDC counter, and at a step S723, the present DKAF(k) value of the difference DKAF is set to the immediately preceding value DKAF (k−1) of the same. Then, a learned value KREF is calculated at a step S724, followed by terminating the program.

Next, the calculation of the PID correction coefficient KLAN by the use of the P-term and the I-term alone PI feedback control) executed at the steps S725 et seq. will be described.

First, a manner of calculating the PID correction coefficient KLAN by the use of the P-term and the I-term alone will be described with reference to a timing chart formed by FIG. 7A to FIG. 7E. The timing chart shows the relationship between an inversion flag FAFRPM, the actual equivalent ratio KACT, the PID correction coefficient KLAF, and the count NWAVE of an NWAVE counter, referred to hereinafter, during execution of the response deterioration determination (i.e. when a response deterioration determination execution flag FLFRPM, which, when set to "1", indicates that the response deterioration determination is being executed, assumes "1"). During execution of the response deterioration determination, the PID feedback control normally carried out by the use of the P-term, the I-term and the D-term is inhibited, and the supply air-fuel ratio is controlled by the PI feedback control by the use of the P-term and the I-term alone.

Figure 7:
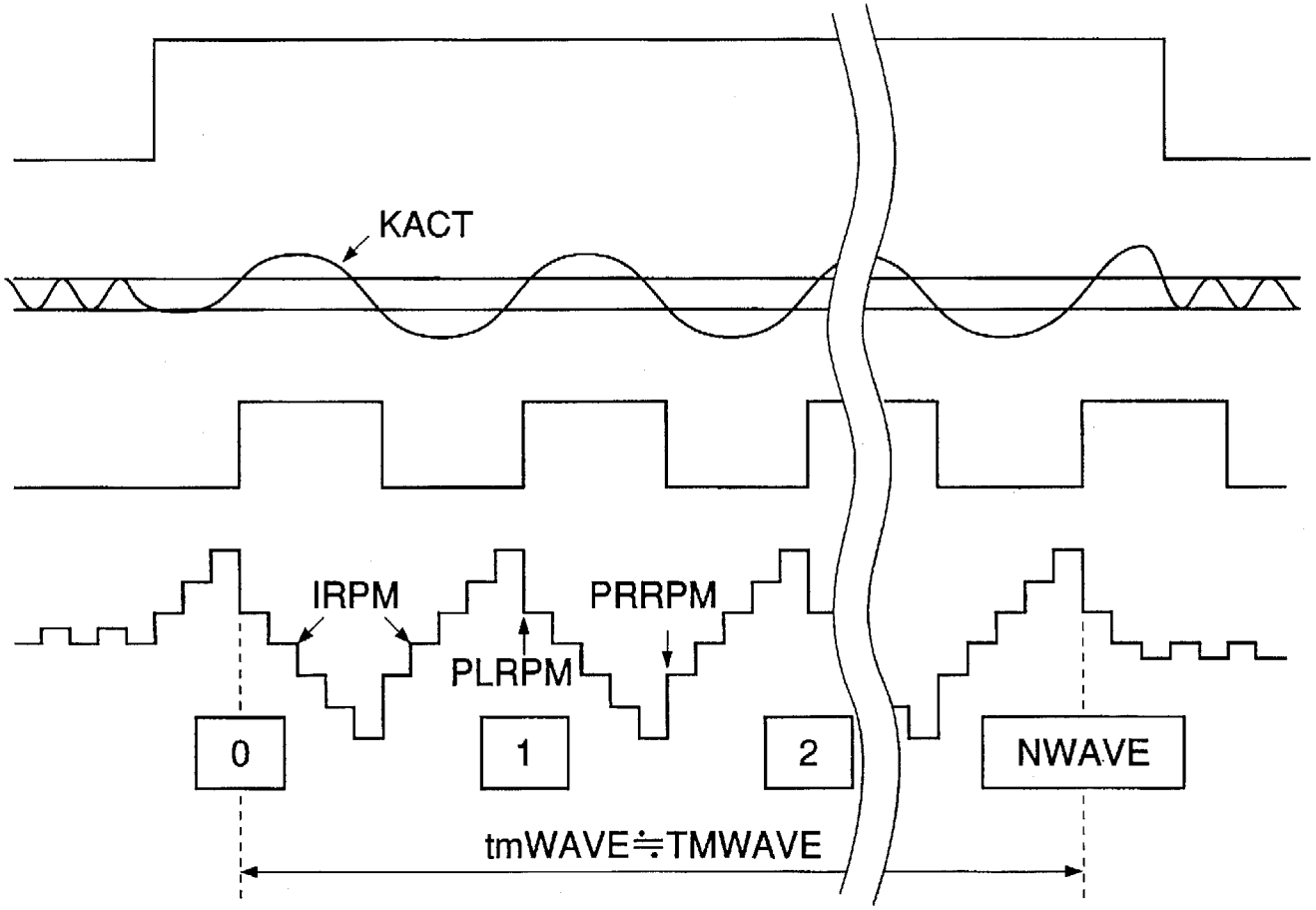

As shown in FIG. 7B, an inversion-determining reference value KCMRP with respect to which the actual equivalent ratio KACT is determined to be inverted is provided with hysteresis. That is, in determining the inversion of the actual equivalent ratio KACT from a leaner side to a richer side, a reference value KCMRPH is used as the inversion-determining reference value KCMRP, whereas in determining the inversion of the actual equivalent ratio KACT from the richer side to the leaner side, a reference value KCMRPL is used as the same. Accordingly, as shown in FIG. 7C, the inversion flag FAFRMP is set to "1" when the actual equivalent ratio KACT becomes larger than the reference value KCMRPH, whereas the inversion flag FAFRMP is set to "0" when the actual equivalent ratio KACT becomes smaller than the reference value KCMRPH. The PI feedback control is a combination of integral term control, in which, while FAFRPM=1 holds, an integral term IRPM is repeatedly subtracted from the PID correction coefficient KLAF to progressively decrease the KLAF value, whereas while FAFRPM=0 holds, the integral term IRPM is repeatedly added to the PID correction coefficient KLAF to progressively increase the KLAF value, and proportional term control, in which a proportional term PRRPM is added to the PID correction coefficient KLAF when the inversion flag FAFRPM is inverted to "0" to indicate the actual air-fuel ratio is on the leaner side, and a proportional term PLRPM is subtracted from the PID correction coefficient KLAF when the inversion flag FAFRPM is inverted to "1" to indicate the actual equivalent ratio KACT is on the richer side. A manner of determining the response deterioration of the LAF sensor 17 will be described hereinafter.

Referring again to FIG. 5, it is determined at the step S725 whether or not the actual equivalent ratio KACT has been inverted with respect to the inversion-determining reference value KCMRP (KCMRPH, KCMRPL). If the actual equivalent ratio KACT has not been inverted, the program proceeds to a step S732, wherein it is determined whether or not the count NITDC of the NITDC counter is equal to "0". If NITDC=0 does not hold, the count NITDC of the NITDC counter is decremented by "1" to-update the same at a step S737, followed by the program proceeding to a step S738, whereas if NITDC=0 holds at the step S732, it is determined at a step S733 whether or not the inversion flag FAFRMP assumes "1". If FAFRPM=0 holds, which means that the actual equivalent ratio KACT is on the leaner side, the integral term IRPM is added to the PID correction coefficient KALF(k) to update the present KLAF(k) value at a step S734, whereas if FAFRPM=1 holds, which means that the actual equivalent ratio KACT is on the richer side, the integral term IRPM is subtracted from the PID correction coefficient KLAF(k) to update the present KLAF(k) value at a step S735. Then, the program proceeds to a step S736, wherein a predetermined value NIRPM as the thinning variable is set to the NITDC counter, followed by the program proceeding to the step S738.

If it is determined at the step S725 that the actual equivalent ratio KACT has been inverted with respect to the inversion-determining reference value KCMRP, the program proceeds to a step S726, wherein it is determined whether or not the actual equivalent ratio KACT is larger than the inversion-determining reference value KCMRP. If KACT>KCMRP holds at the step S726, an inversion flag FAFRPMC, which, when set to "1", indicates that the actual equivalent ratio KACT has been inverted from the leaner side to the richer side with respect to the inversion-determining reference value KCMRPH, is set to "1" at a step S729, and the inversion flag FAFRPM is set to "1" at a step S730. Then, the proportional term PLRPM is subtracted from the PID correction coefficient KLAF(k) to update the present KLAF(k) value at a step S731, followed by the program proceeding via the step S736 to the step S738.

On the other hand, if KACT≦KCMRP holds at the step S726, the inversion flag FAFRPM is set to "0" at a step S727, and the proportional term PRRPM is added to the PID correction coefficient KLAF(k) at a step S728, followed by the program proceeding via the step S736 to the step S738.

At the step S738, it is determined whether or not the KLAF(k) value is larger than a predetermined upper limit value KLAFLMTH'. If KLAF(k)>KLAFLMTH' holds, the KLAF(k) value is set to the predetermined upper limit value KLAFLMTH' at a step S741, followed by terminating the program.

If KLAF(k)≦KLAFLMTH' holds at the step S738, it is determined at a step S739 whether or not the KLAF(k) value is larger than a predetermined lower limit value KLAFLMTL'. If KLAF(k)≧KLAFLMTL' holds, the program is immediately terminated, whereas if KLAF(k) <KLAFLMTL' holds, the KLAF(k) value is set to the predetermined lower limit value KLAFLMTL' at a step S740, followed by terminating the program.

Figure 3:
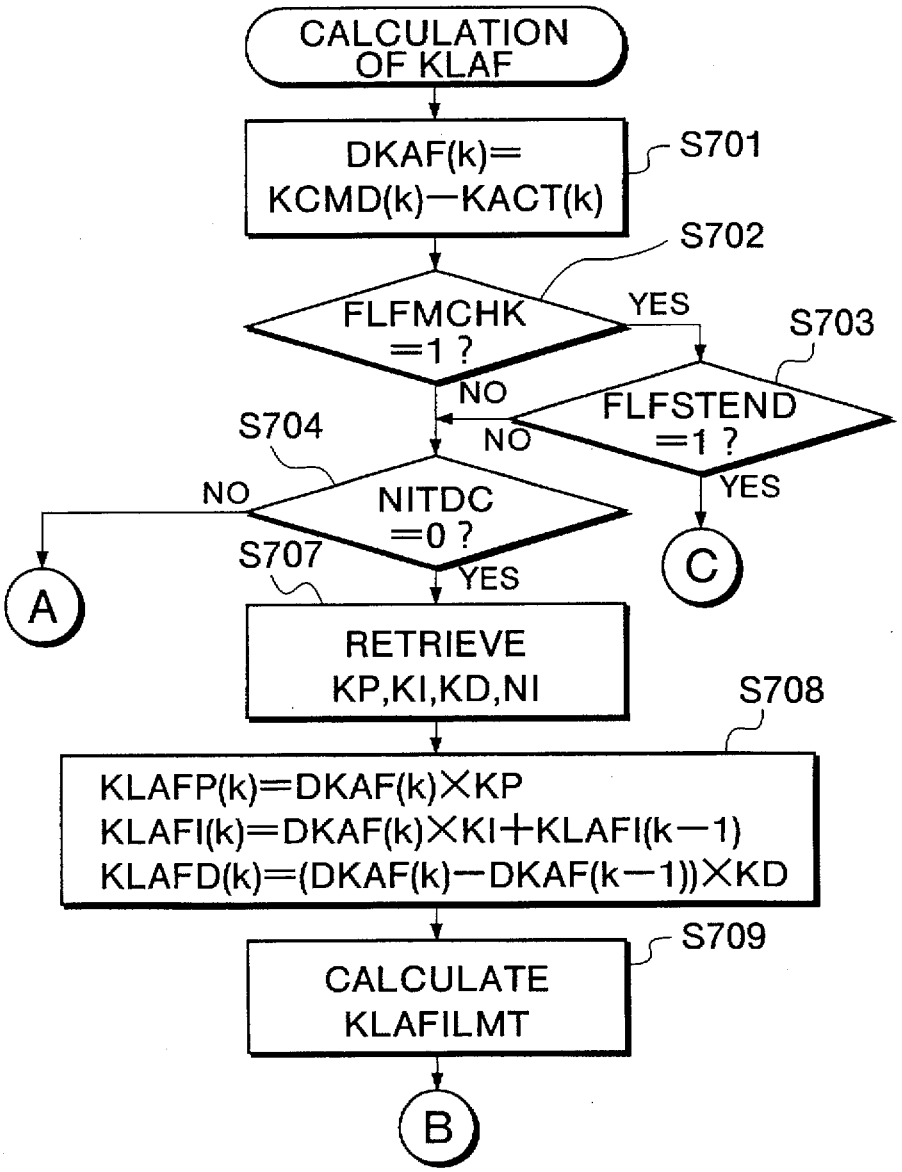
FIG. 3 is a flowchart showing a subroutine for calculating the PID correction coefficient KLAF, which is executed at a step S10 in FIG. 2.
Figure 4:
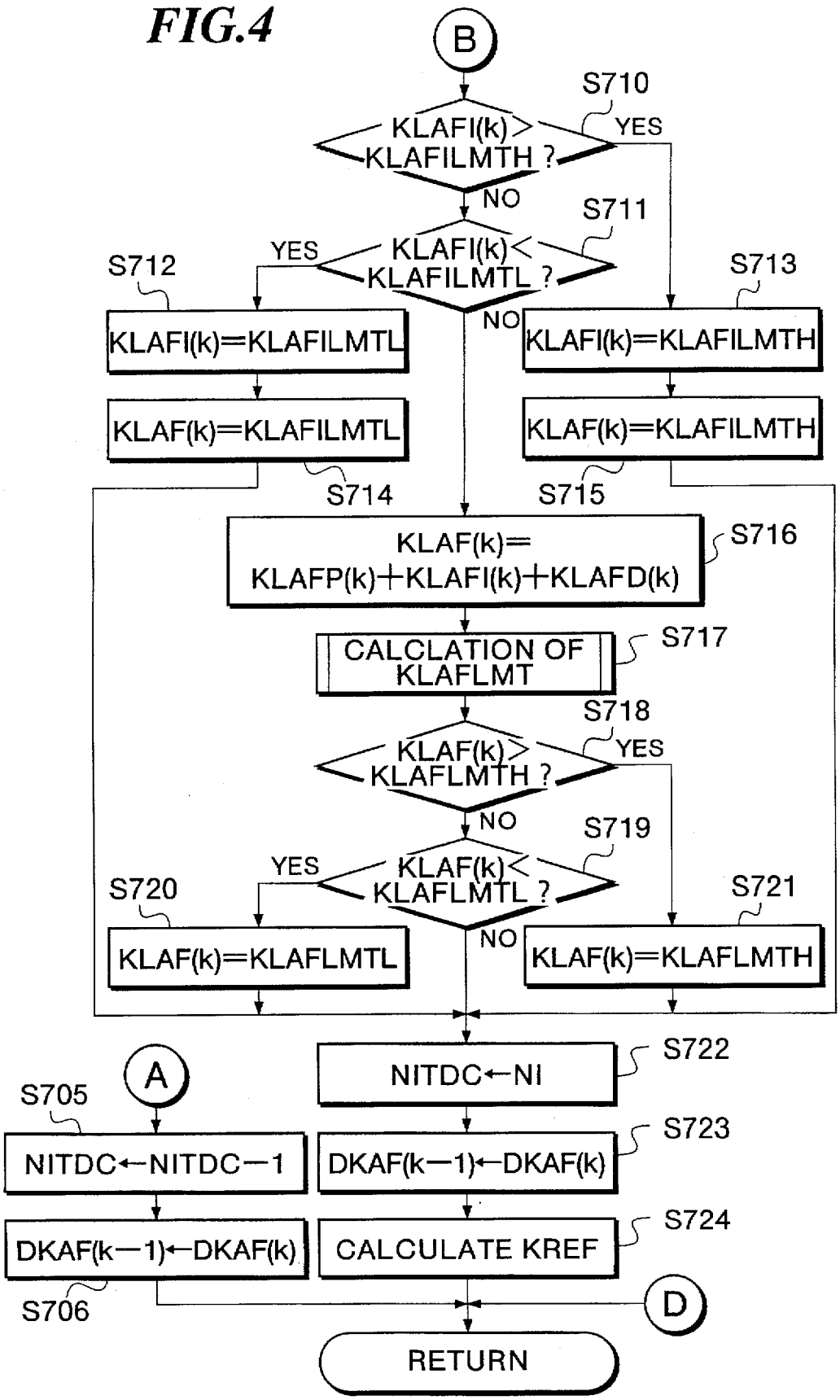
FIG. 4 is a continued part of the FIG. 3 flowchart.
Figure 5:
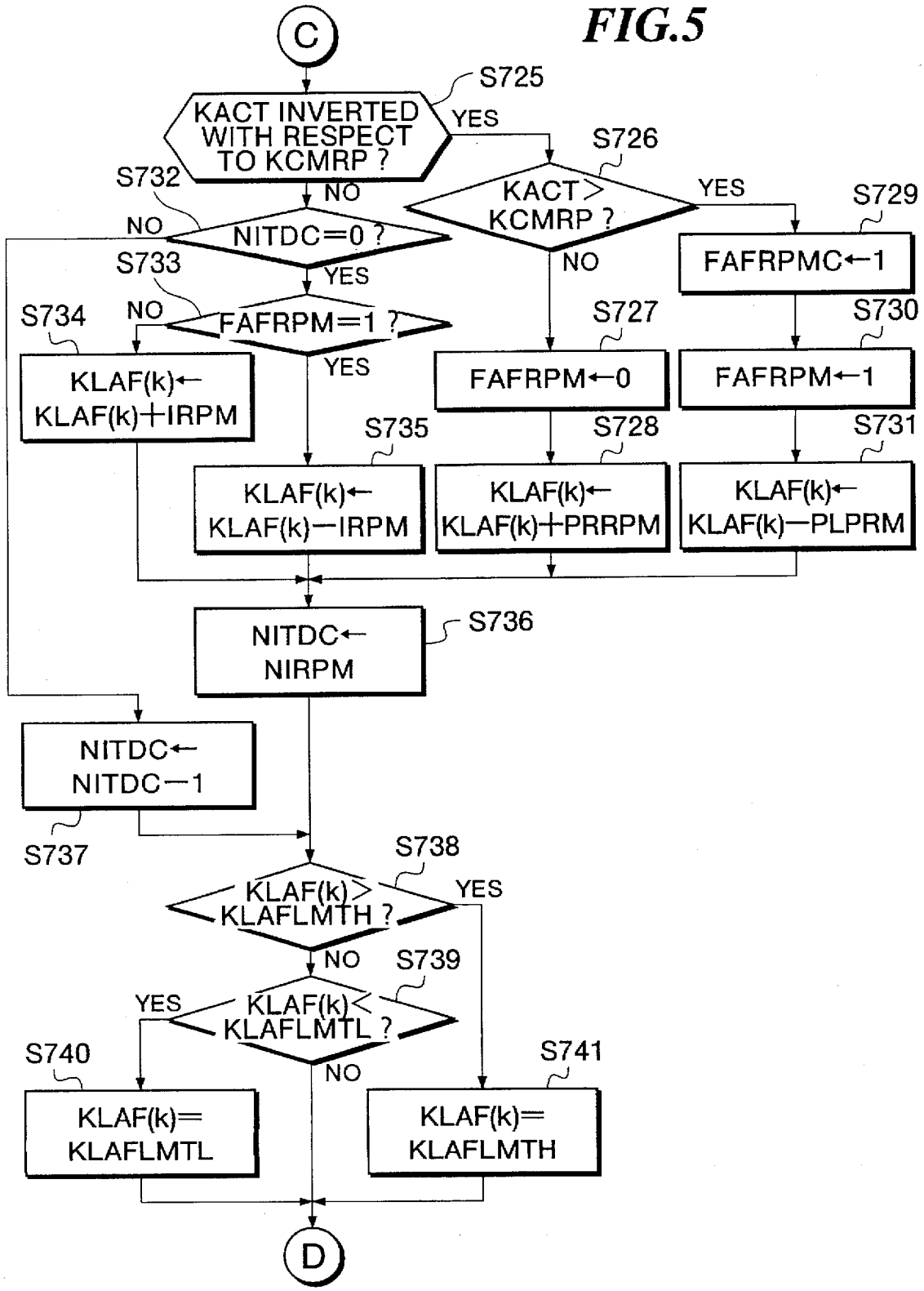
FIG. 5 is a continued part of the FIG. 3 flowchart.

By executing the FIGS. 3 to 5 routine, when the response deterioration determination of the LAF sensor 17 is permitted during the ordinary PID feedback control of the supply air-fuel ratio, the air-fuel ratio feedback control is changed over from the PID feedback control to the PI feedback control, in which the PID correction coefficient KLAF is increased and decreased by the use of the proportional term IRPM and the integral terms PLRPM and PRRPM, all of which are set to respective predetermined values. Therefore, the repetition period of inversion of the actual equivalent ratio KACT occurring in response to predetermined amounts of changes (IRPM, PLRPM, PRRPM) in the control amount (KLAF) becomes more positive and clearer, so that the repetition period of inversion of the actual equivalent ratio KACT can be determined more accurately. This enables the response deterioration of the LAF sensor 17 to be determined easily and accurately, as described hereinafter.

Further, since hysteresis is provided for the inversion-determining reference value KCMRP with respect to which the actual equivalent ratio KACT is determined to be inverted from the leaner side to the richer side or vice versa, the repetition period of inversion of the actual equivalent ratio KACT is made even more positive, whereby the above response deterioration determination of the LAF sensor can be made more easily and more accurately.

As shown in FIGS. 7A to 7E, the PI feedback control and the hysteresis provided for the inversion-determining reference value KCMRP cause the actual equivalent ratio KACT to change such that the waveform of changes in the actual equivalent ratio KACT is increased in amplitude and repetition period, whereby the value of the actual equivalent ratio KACT, i.e. the output characteristics of the LAF sensor 17 is made more positive.

Next, the manner of determining the deterioration of the LAF sensor 17 will be described.

Figure 6:
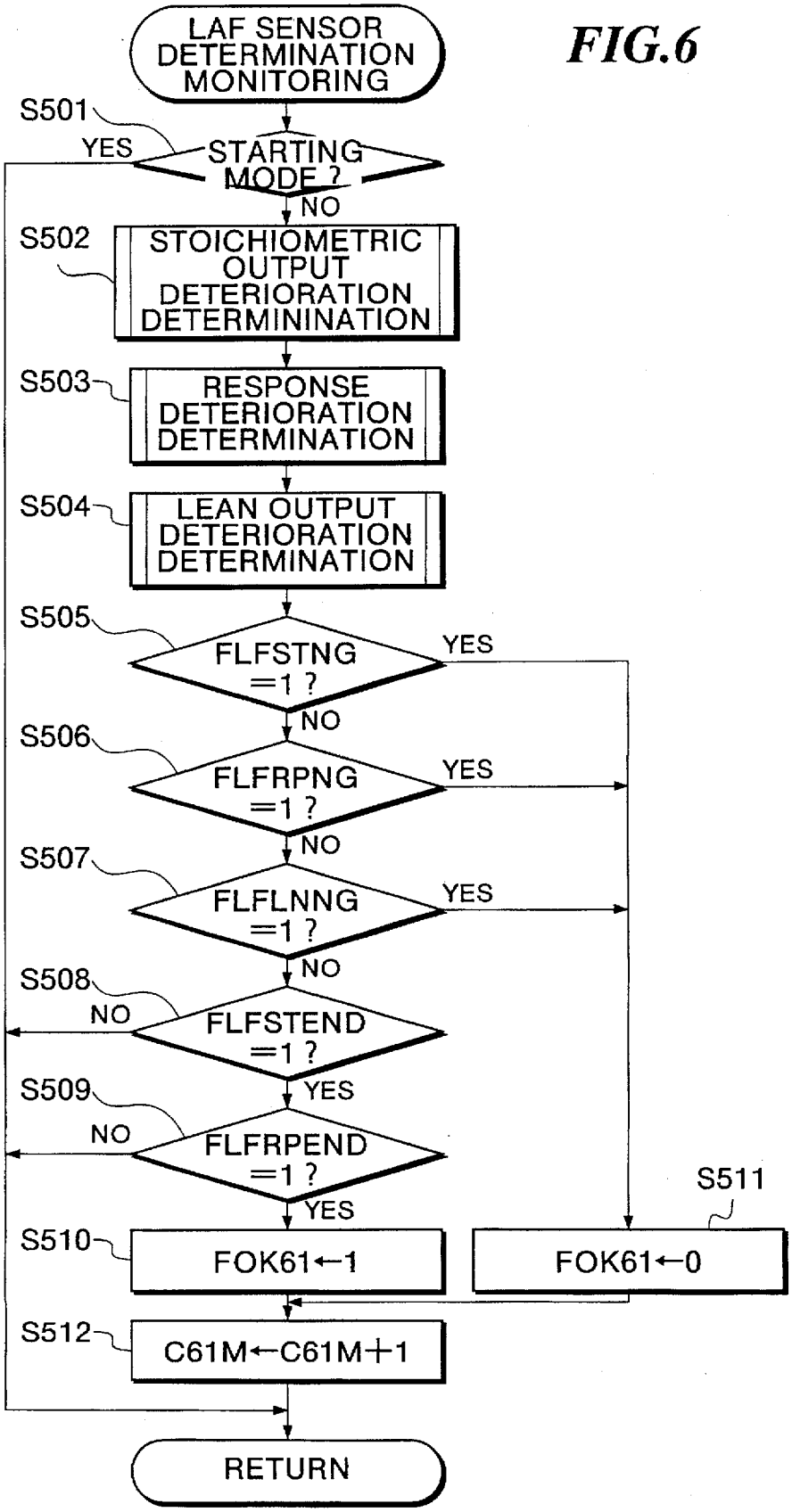
FIG. 6 is a flowchart showing a main routine for determining whether the LAF sensor has been deteriorated.

FIG. 6 shows a main routine for determining whether the LAF sensor 17 has been deteriorated, which is executed at predetermined time intervals of e.g. 10 msec.

First, at a step S501, it is determined whether or not the engine is in the starting mode, i.e. being cranked. If the engine is in the starting mode, the present processing is immediately terminated, whereas if the engine is not in the starting mode, determinations of the stoichiometric output deterioration, the response deterioration, and deterioration of a lean output characteristic (lean output deterioration) of the LAF sensor 17 are executed sequentially at respective steps S502, S503, and S504. Then, it is determined at a step S505 whether or not a stoichiometric output deterioration flag FLFSTNG, which, when set to "1", indicates that the stoichiometric output deterioration has been detected, assumes "1". If FLFSTNG=0 holds at the step S505, it is determined at a step S506 whether or not a response deterioration flag FLFRPNG, which, when set to "1", indicates that the response deterioration has been detected, assumes "1". If FLFRPNG=0 holds at the step S506, it is determined at a step S507 whether or not a lean output deterioration flag FLFLNNG, which, when set to "1", indicates that the lean output deterioration has been detected, assumes "1".

If any of the answers to the questions of the steps S505 to S507 is affirmative (YES), i.e. any of the above types of the LAF sensor deterioration has been detected, an OK flag FOK61, which, when set to "1", indicates that the LAF sensor 17 has not been deteriorated, is set to "0" at a step S511, and the count of a counter C61M is incremented by "1" at a step S512, followed by terminating the program.

On the other hand, if all the answers to the questions of the steps S505 to S507 are negative (NO), it is determined at a step S508 whether or not the stoichiometric output deterioration determination termination flag FLFSTEND assumes "1". If FLFSTEND=1 holds at the step S508, it is determined at a step S509 whether or not a response deterioration determination termination flag FLFRPEND, which, when set to "1", indicates that the response deterioration determination has been terminated, assumes "1". If the answer to the question of either the step S508 or the step S509 is negative (NO), the present program is immediately terminated, whereas both the answers to these questions are affirmative (YES), the OK flag FOK61 is set to "1" at a step S510, followed by the program proceeding to the step S512.

Figure 8:
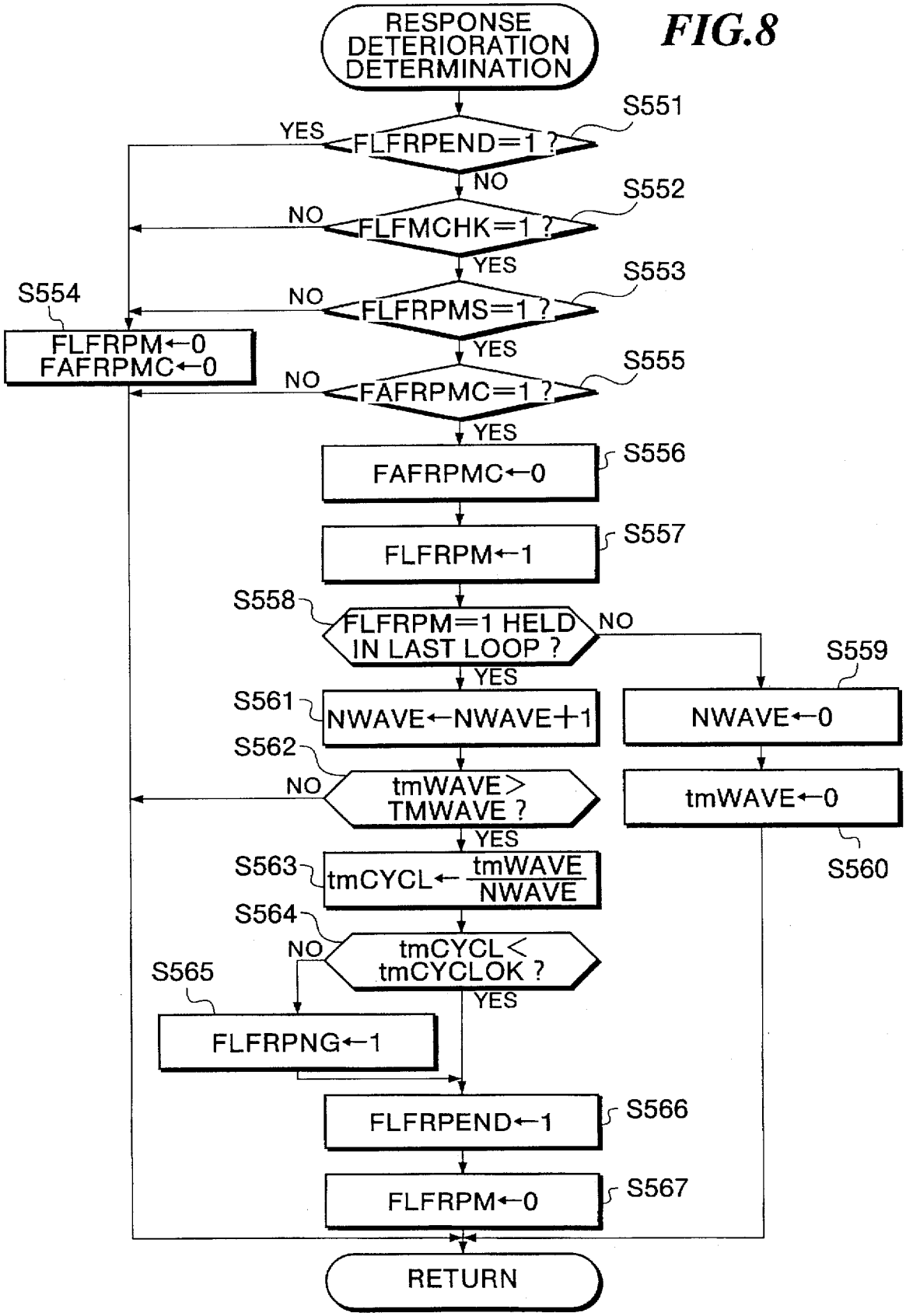
FIG. 8 is a flowchart showing a subroutine for determining the response deterioration of the LAF sensor, which is executed at a step S503 in FIG. 6.

FIG. 8 shows a subroutine for determining the response deterioration of the LAF sensor 17, which is executed at the step S503 of the FIG. 6 routine.

First, at a step S551, it is determined whether or not the response deterioration determination termination flag FLFRPEND assumes "1". If FLFRPEND=0 holds at the step S551, it is determined at a step S552 whether or not the monitoring condition flag FLFMCHK assumes "1". If FLFMCHK=1 holds, i.e. if the monitoring conditions are fulfilled, it is determined at a step S553 whether or not a response deterioration determination start flag FLFRPMS, which, when set to "1" in a routine described hereinafter with reference to FIG. 9, indicates that conditions for starting the response deterioration determination are fulfilled, assumes "1". If FLFRPEND=1 holds at the step S551, if FLFMCHK=0 at the step S552, or if FLFRPMS=0 at the step S553, the response deterioration determination execution flag FLFRPM and the inversion flag FAFRPMC are set to "0" at a step S554, followed by terminating the program.

On the other hand, if the response deterioration determination start flag FLFRPMS assumes "1" at the step S553, it is determined at a step S555 whether or not the inversion flag FAFRPMC assumes "1". If FAFRPMC=0 holds, the program is immediately terminated, whereas if FAFRPMC=1 holds, the inversion flag FAFRPMC is set to "0" at a step S556. Then, the response deterioration determination execution flag FLFRPM is set to "1" at a step S557, and then it is determined at a step S558 whether or not the flag FLFRMP assumed "1" in the immediately preceding loop. If FLFRPM=0 held in the immediately preceding loop, the NWAVE counter and a tmWAVE upcount timer are both set to "0" at respective steps S559 and S560, followed by terminating the program.

If it is determined at the step S558 that FLFPRM=1 held in the immediately preceding loop as well, the count NWAVE of the NWAVE counter is incremented by "1" at a step S561, and it is determined at a step S562 whether or not the count tmWAVE of the tmWAVE upcount timer has exceeded a predetermined time period TMWAVE. If tmWAVE≦TMWAVE holds, the present program is immediately terminated, whereas if tmWAVE>TMWAVE holds, the repetition period tmCYCL of inversion of the actual equivalent ratio KACT is calculated by the use of the following equation (6):

$$tmCYCL=tmWAVE/NWAVE \quad (6)$$

At the following step S564, it is determined whether or not the repetition period tmCYL is shorter than a predetermined repetition period tmCYCLOK. If tmCYCL<tmCYLOK holds, the response deterioration determination termination flag FLFRPEND is set to "1" at a step S566, and the response deterioration determination execution flag FLFRPM is set to "0" at a step S567, followed by terminating the program.

If tmCYCL≧tmCYCLOK holds at the step S564, it is determined that the LAF sensor 17 is deteriorated in respect of response, so that the response deterioration flag FLFR- PNG is set to "1" at a step S565, followed by the program proceeding to the step S566.

According to the FIG. 8 routine described above, as shown in FIGS. 7A to 7E, substantially over the predetermined time period TMWAVE (see FIG. 7E), the repetition period of inversion of the actual equivalent ratio KACT is calculated with increased positiveness through inhibition of the differential term control in calculating the PID correction coefficient KLAF and provision of hysteresis for the inversion-determining reference value KCMRP, whereby the response deterioration of the LAF sensor 17 is determined easily and accurately based on the repetition period thus determined.

Figure 9:
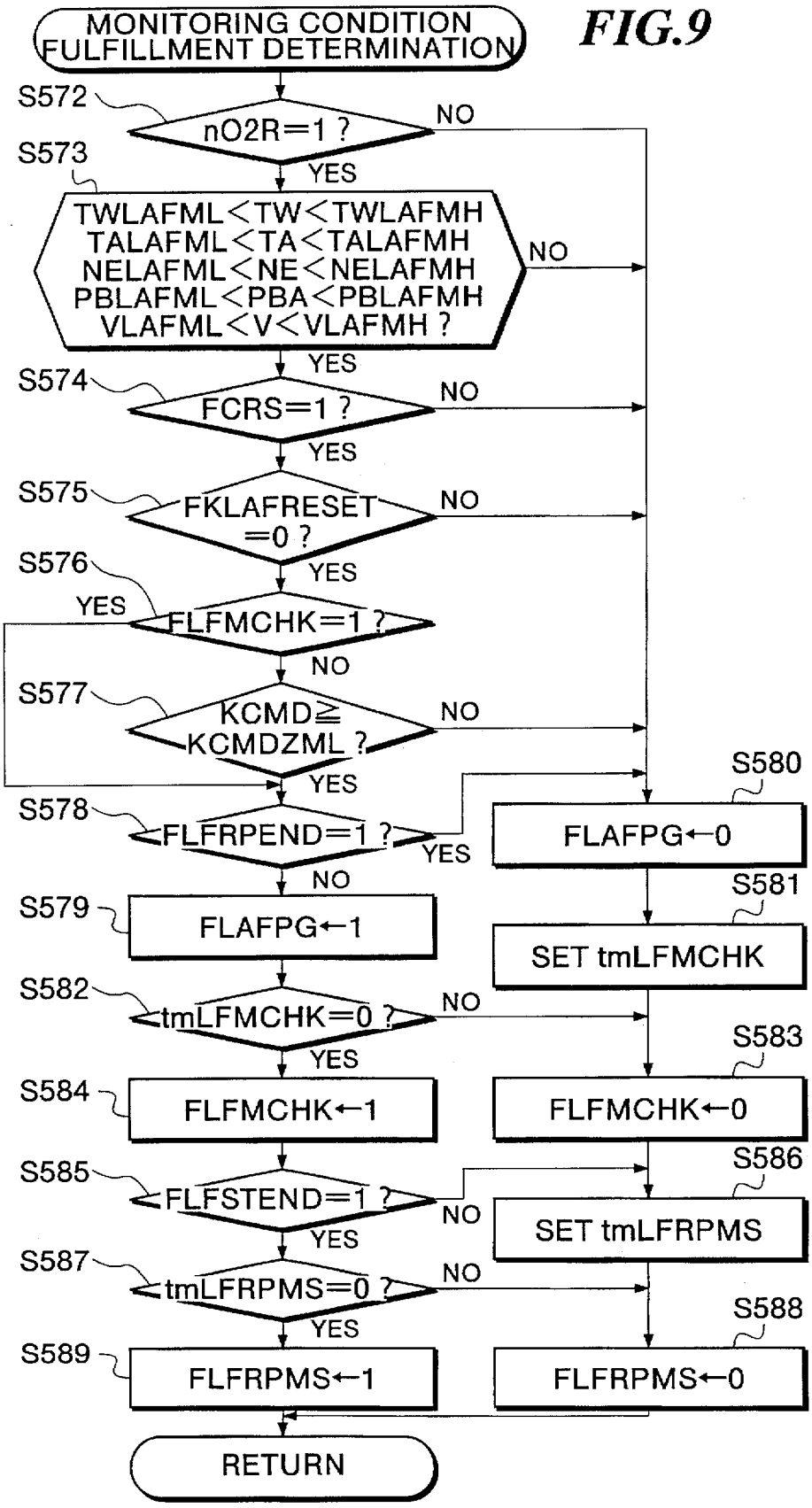
FIG. 9 is a flowchart showing a background routine for determining whether or not monitoring conditions, i.e. conditions for determining the response deterioration of the LAF sensor or deterioration of a stoichiometric output characteristic (stoichiometric output deterioration) of the same are fulfilled.

FIG. 9 shows a monitoring condition-determining routine for determining whether or not the monitoring conditions are fulfilled for determining the response deterioration and the stoichiometric output deterioration of the LAF sensor, which is executed as background processing when no higher priority processing is carried out.

First, at a step S572, it is determined whether or not an activation flag nO2R, which, when set to "1", indicates that the O2 sensor 18 has been activated, assumes "1". If nO2R=1 holds, it is determined at a step S573 whether or not the engine 1 and the vehicle on which the engine 1 is installed are in predetermined operating conditions.

More specifically, it is determined whether or not the engine coolant temperature TW is within a range defined by predetermined upper and lower limit values TWLAFMH and TWLAFML, the intake air temperature TA within a range defined by predetermined upper and lower limit values TALAFMH and TALAFML, the engine rotational speed NE within a range defined by predetermined upper and lower limit values NELAFMH and NELAFML, the intake pipe absolute pressure PBA within a range defined by predetermined upper and lower limit values PBLAFMH and PBLAFML, and the vehicle speed V within a range defined by upper and lower limit values VLAFMH and VLAFML. If all the answers to these questions are affirmative (YES), it is determined that the engine 1 and the vehicle are in the predetermined operating conditions.

Further, it is determined at a step S574 whether or not a flag FCRS, which, when set to "1", indicates that the vehicle is in a cruising condition in which the rate of change in the vehicle speed V is small, assumes "1". If FCRS=1 holds, it is determined at a step S575 whether or not the KLAF reset flag FKLAFRESET assumes "0".

If any of the answers to the questions of the steps S572 to S575 are negative (NO), it is determined that the monitoring conditions are not fulfilled, and then the program proceeds to a step S580, wherein a purge-cut flag FLAFPG, which, when set to "1", indicates that the purging of evaporative fuel should be inhibited, is set to "0", and then a tmLFMCHK downcount timer is set to a predetermined time period TLFMCHK and started at a step S581. The monitoring condition flag FLFMCHK is set to "0" at a step S583, a tmLFRPMS downcount timer is set to a predetermined time period TLFRPMS and started at a step S586, and the response deterioration determination start flag FLFRPMS is set to "0" at a step S588, followed by terminating the program.

If FKLAFRESET=0 holds at the step S575, which means that the engine is operating in the air-fuel ratio feedback control region, it is determined at a step S576 whether or not the monitoring condition flag FLFMCHK assumes "1". If FLFMCHK=1 holds, the program jumps to a step S578, whereas if FLFMCHK=0 holds, it is determined at a step S577 whether or not the desired equivalent ratio KCMD is equal to or larger than a predetermined value KCMDZML (which is set e.g. to a value corresponding to the stoichiometric air-fuel ratio, i.e. 1.0). If KCMD<KCMDZML holds at the step S577, it is determined that the monitoring conditions are not fulfilled, and then the program proceeds to the step S580, whereas if KCMD≧KCMDZML holds, the program proceeds to the step S578.

At the step S578, it is determined whether or not the response deterioration determination termination flag FLFRPEND assumes "1". If FLFRPEND=1 holds, which means that the response deterioration determination has been terminated, the program proceeds to the step S580, whereas if FLFRPEND=0 holds, the purge-cut flag FLAFPG is set to "1" at a step S579 to inhibit purging of evaporative fuel, and then it is determined at a step S582 whether or not the count of the downcount timer tmLFMCHK started at the step S581 is equal to "0". When this step is first executed, tmLFMCHK>0 holds, so that the program proceeds to the step S583, and when tmLFMCHK=0 holds, it is judged that the monitoring conditions are fulfilled, and the monitoring condition flag FLFMCHK is set to "1" at a step S584. Then, it is determined at a step S585 whether or not the stoichiometric output deterioration determination termination flag FLFSTEND assumes "1".

If FLFSTEND=0 holds at the step S585, which means that the stoichiometric output deterioration determination has not been terminated, the program proceeds to the step S586, whereas if FLFSTNED=1 holds after termination of the stoichiometric output deterioration determination, the program proceeds to a step S587, wherein it is determined whether or not the count of the downcount timer tmLFRPMS is equal to "0". When this step is first executed, tmLFRPMS>0 holds, so that the program proceeds to the step S588, and when tmLFRPMS=0 holds, the response deterioration determination start flag FLFRPMS is set to "1" at a step S589, thereby permitting starting of the response deterioration determination.

As described above, according to the present embodiment, the air-fuel ratio control system which controls the supply air-fuel ratio by the PID feedback control calculates the repetition period of inversion of the actual equivalent ratio KACT in a more positive manner through inhibition of the differential term control, i.e. by executing the PI feedback control by the use of the P-term and the I-term alone, whereby the response deterioration of the LAF sensor 17 can be determined easily and accurately based on the repetition period of inversion of the actual equivalent ratio KACT thus determined. This enables the driver to notice such a faulty condition of the LAF sensor at an early stage, so that it is possible to prevent degradation of the exhaust emission characteristics and driveability of the engine.

Next, a second embodiment of the invention will be described with reference to FIGS. 10 to 17.

The air-fuel ratio control system of the present embodiment is identical in arrangement with the whole arrangement of the FIG. 1 air-fuel ratio control system of the first embodiment. Component elements and parts of the engine and the system corresponding to those of the first embodiment are designated by identical reference numerals, and description thereof is omitted. The FIG. 2 main routine for calculating the PID correction coefficient KLAF, the FIG. 6 main routine for determining the LAF sensor deterioration, and the FIG. 9 monitoring condition-determining routine are also used in the present embodiment.

The present embodiment is characterized by the manner of determining the stoichiometric output deterioration of the LAF sensor, which will be described in detail hereinafter.

In the present embodiment, the fuel injection period TOUT is normally calculated by the use of the PID correction coefficient KLAF determined through the PID feedback control responsive to the output from LAF sensor 17 by the use of the following equation (7):

$$TOUT=K1\times KLAF\times KCMD\times Ti+K2 \quad (7)$$

where Ti represents a basic fuel amount, i.e. a basic value of the fuel injection period TOUT, which is determined in accordance with the engine rotational speed NE and the intake pipe absolute pressure PBA, and K1 represents the product of correction coefficients determined depending on operating conditions of the engine, and K2 the sum of correction variables determined depending on operating conditions of the engine.

FIG. 10 shows a subroutine for calculating the PID correction coefficient KLAF in response to the output from the LAF sensor, which is executed at the step S10 in FIG. 2.

First, at a step S301, it is determined whether or not a hold flag FKLAFHOLD, which, when set to "1", indicates that the PID correction coefficient KLAF should be held at the present value, assumes "1". If the engine is in any of the open-loop control regions, FKLAFHOLD=1 holds, so that the present processing is immediately terminated, whereas if FKLAFHOLD=0 holds, the program proceeds to a step S302, wherein it is determined whether or not the KLAF reset flag FKLAFRESET assumes "1". If FKLAFRESET=1 holds, the program proceeds to a step S303, wherein the PID correction coefficient KLAF is set to "1.0" and at the same time an integral term control gain KI and the difference DKAF between the desired equivalent ratio KCMD and the actual equivalent ratio KACT are both set to "0", thus initializing these coefficients, followed by terminating the program.

If FKLAFRESET=0 holds at the step S302, the program proceeds to a step S304, wherein a proportional term control gain KP, the integral term control gain KI and a differential term control gain KD are retrieved from respective maps according to the engine rotational speed NE and the intake pipe absolute pressure PBA. In this connection, during idling of the engine, gain values for the idling condition are adopted. Then, the difference DKAF(k) (=KCMD(k)−KACT(k)) between the present KCMD value KCMD(k) and the present KACT value KACT(k) is calculated at a step S305, and the difference DKAF(k) and the gains KP, KI, and KD are applied to the following equations (2) to (4) to calculate a proportional term KLAFP(k), an integral term KLAFI(k), and a differential term KLAFD(k) at a step S306:

$$KLAFP(k)=DKAF(k)\times KP \quad (2)$$

$$KLAFI(k)=DKAF(k)\times KI+KLAFI(k-1) \quad (3)$$

$$KLAFD(k)=(DKAF(k)-DKAF(k-1))\times KD \quad (4)$$

At the following steps S307 to S310, limit-checking of the integral term KLAFI(k) is carried out. More specifically, it is determined whether or not the KLAFI(k) value falls within a range defined by predetermined upper and lower limit values KLAFILMTH and KLAFILMTL at steps S307, S308, respectively. If KLAFI(k)>KLAFILMTH holds, the integral term KLAFI(k) is set to the predetermined upper limit value KLAFILMTH at a step S310, whereas if FLAFI (k)<KLAFILIMTL holds, the same is set to the predetermined lower limit value KLAFILMTL at a step S309.

At the following step S311, the PID correction coefficient KLAF(k) is calculated by the use of the following equation (8):

$$KLAF(k)=KLAFP(k)+KLAFI(k)+KLAFD(k)+1.0 \quad (8)$$

Then, it is determined at a step S312 whether or not the KLAF(k) value is larger than a predetermined upper limit value KLAFLMTH. If KLAF(k)>KLAFLMTH holds, the PID correction coefficient KLAF is set to the predetermined upper limit value KLAFLMTH at a step S316, followed by terminating the program.

If KLAF(k)≦KLAFLMTH holds at the step S312, it is determined at a step S314 whether or not the KLAF(k) value is smaller than a predetermined lower limit value KLAFLMTL. If KLAF(k)≧KLAFLMTL holds, the present program is immediately terminated, whereas if KLAF(k) <KLAFLMTL holds, the PID correction coefficient KLAF is set to the predetermined lower limit value KLAFLMTL at a step S315, followed by terminating the program.

By the above subroutine, the PID correction coefficient KLAF is calculated by the PID feedback control such that the actual equivalent ratio KACT becomes equal to the desired equivalent ratio KCMD.

Next, the manner of determining the stoichiometric output deterioration of the LAF sensor 17 will be described with reference to FIGS. 13A to 13C. As shown in these figures, according to this deterioration determination, so long as the output from the O2 sensor 18 is at a high level (indicating that the detected air-fuel ratio is richer than the stoichiometric air-fuel ratio), the desired equivalent ratio KCMD is progressively decreased, whereas so long as the same is at a low level (indicating that the detected air-fuel ratio is leaner than the stoichiometric air-fuel ratio), the desired equivalent ratio KCMD is progressively increased, and then an average value KACTAV [=((KACT(B)+KACT(C)+KACT(C)+KACT(D))/4] of the actual equivalent ratio KACT detected at time points B, C, D, and E of inversion of the output from the O2 sensor with respect to the stoichiometric air-fuel ratio is calculated. Then, if the KACTAV value deviates from 1.0 by a predetermined amount or more, it is determined that the LAF sensor 17 suffers from the stoichiometric output deterioration. The number of sampled values of the actual equivalent ratio KACT for calculating the average value KACTAV is not limited to four, but the number of sampled values of the actual equivalent ratio KACT on the leaner side and the number of sampled values of the same on the richer side have to be equal to each other.

Figure 14:
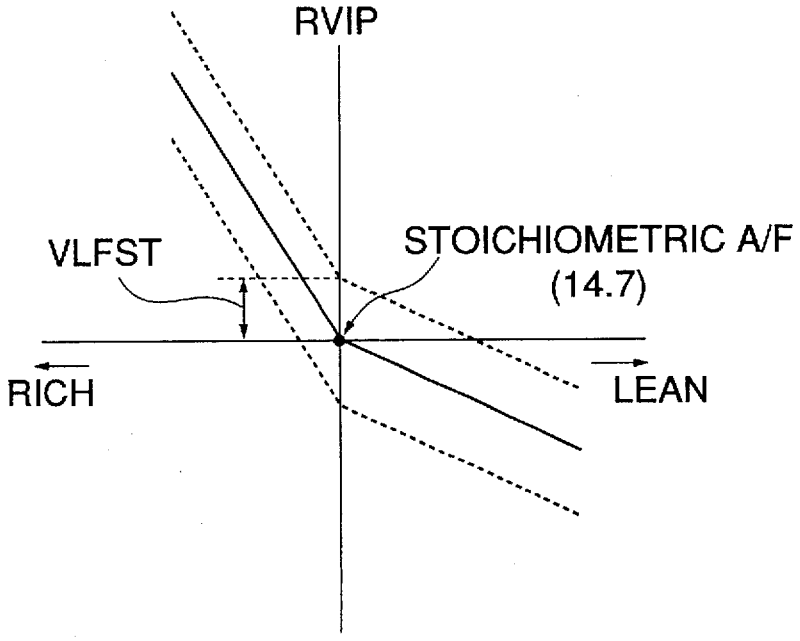
FIG. 14 is a graph which is useful in explaining a deviation amount VLFST of a LAF sensor output RVIP.

FIG. 14 illustrates a deviation amount VLFST of the output RVIP from the LAF sensor 14 (LAF sensor output). As shown in the figure, the LAF sensor output RVIP deviates to the leaner side or richer side by the deviation amount VLFST, as the LAF sensor 17 deteriorates.

The overall deterioration determination of the LAF sensor 17 is executed according to the FIG. 6 routine described hereinabove with respect to the first embodiment.

Figure 11:
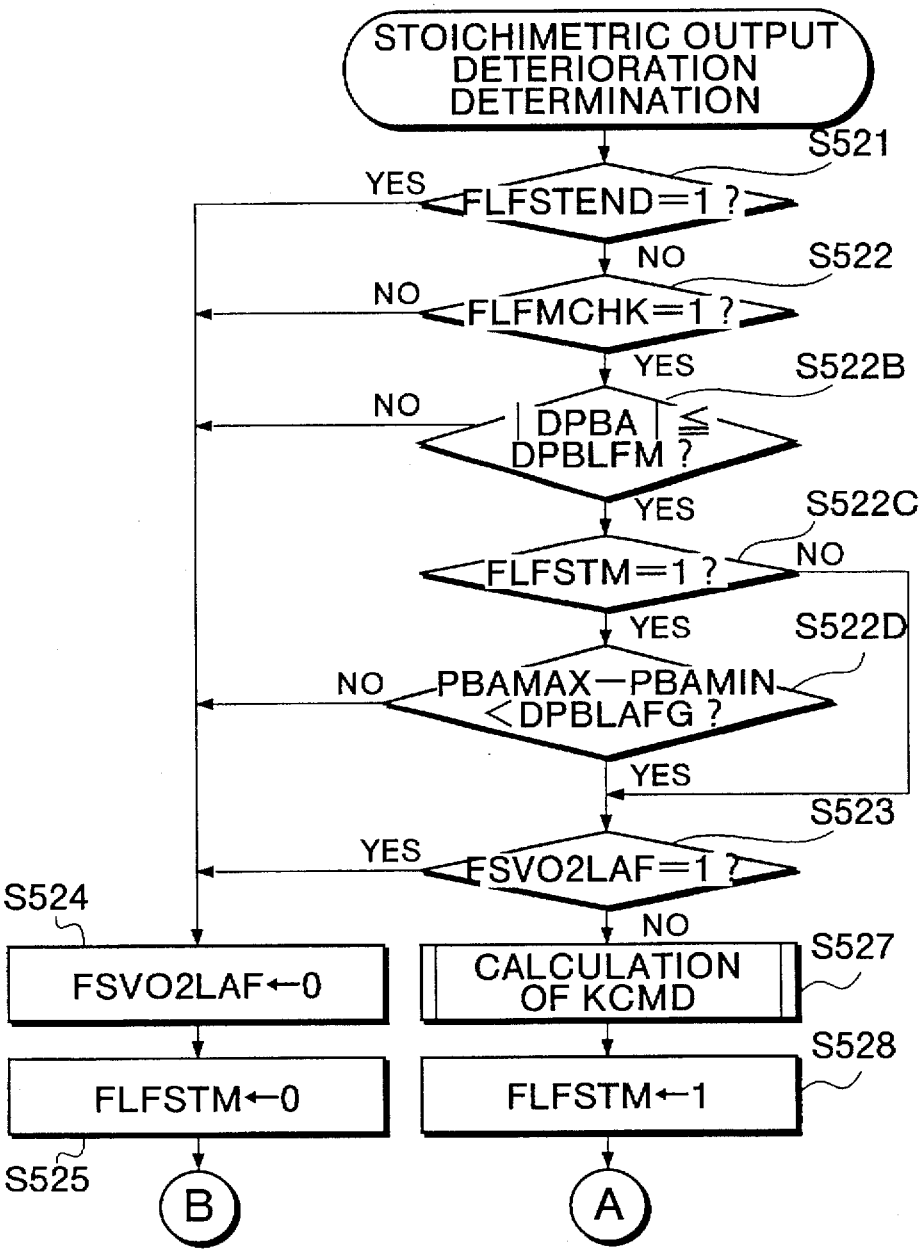
FIG. 11 is a flowchart showing a subroutine for determining the stoichiometric output deterioration of the LAF sensor, which is executed at a step S502 in FIG. 6 by the air-fuel ratio control system according to the second embodiment.
Figure 12:
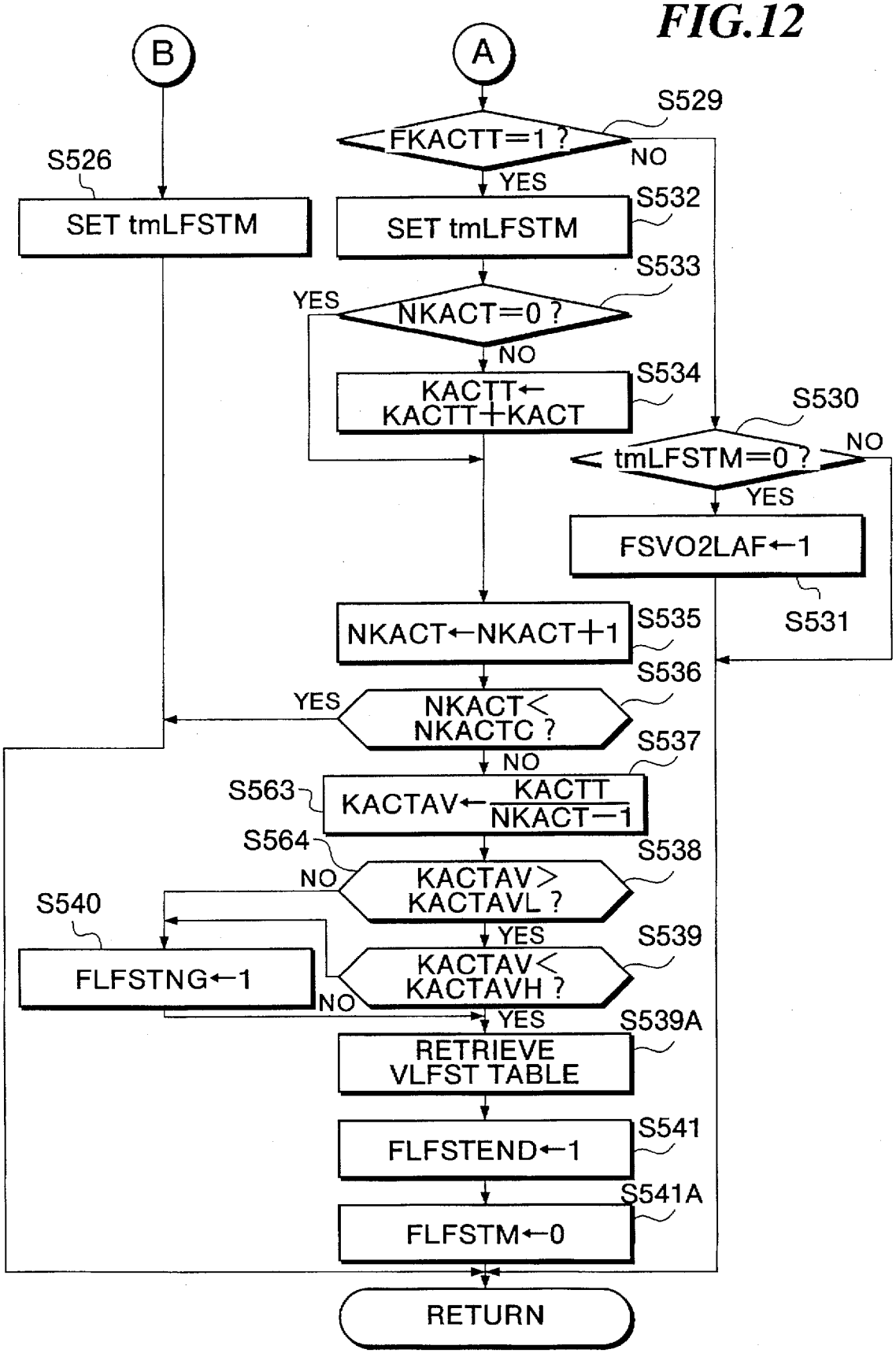
FIG. 12 is a continued part of the FIG. 11 flowchart.

FIGS. 11 and 12 show a subroutine for determining the stoichiometric output deterioration of the LAF sensor, which is executed at the step S502 in FIG. 6.

First, at a step S521, it is determined whether or not the stoichiometric output deterioration determination termination flag FLFSTEND assumes "1". If FLFSTEND=0 holds, i.e. if the stoichiometric output deterioration determination has not been terminated, it is determined at a step S522 whether or not the monitoring condition flag FLFMCHK assumes "1". The monitoring condition flag FLFMCHK is set in the FIG. 9 subroutine, described hereinabove.

If FLFMCHK=1 holds at the step S522, the program proceeds to a step S522B, wherein it is determined whether or not a variation amount |DPBA| as the absolute value of an amount of variation in the intake pipe absolute pressure PBA is larger than a predetermined value DPBLFM. If |DPBA|≦DPBLFM holds at the step S522B, it is determined at a step S522C whether or not a stoichiometric output deterioration determination execution flag FLFSTM, which, when set to "1", indicates that the stoichiometric output deterioration determination is being executed, assumes "1". If FLFSTM=0 holds, the program jumps to a step S523, whereas if FLFSTM=1 holds, it is determined at a step S522D whether or not the difference (PBAMAX–PBAMIN) between the maximum PBA value PBAMAX and the minimum PBA value PBAMIN both obtained after the stoichiometric output deterioration determination was started, i.e. the maximum value of variation in the intake pipe negative pressure during the stoichiometric output deterioration determination, is smaller than a predetermined value DPBLAFG. If (PBAMAX–PBAMIN)<DPBLAFG holds at the step S522D, the program proceeds to the step S523.

At the step S523, it is determined whether or not an O2 sensor output (SVO2) monitoring flag FSVO2LAF assumes "1". If FVO2LAF=0 holds, the program proceeds to a step S527, whereas if the answer to the question of the step S521 or the step S523 is affirmative (YES), or if the answer to the question of the step S522, S522B or S522D is negative (NO), it is determined that the operating condition of the engine is not suitable for the stoichiometric output deterioration determination, so that the SVO2 monitoring flag FSVO2LAF is set to "0" at a step S524, and the stoichiometric output deterioration determination execution flag FLFSTM is set to "0" an a step S525. Then, a downcount timer tmLFSTM is set to a predetermined time period TLFSTM at a step S526, followed by terminating the program.

At a step S527, the desired equivalent ratio KCMD as a target value of the air-fuel ratio feedback control is calculated by executing a subroutine shown in FIG. 16, described hereinafter, and then at a step S528, the stoichiometric output deterioration determination flag FLFSTM is set to "1", followed by the program proceeding to a step S529.

At the step S529, an inversion flag FKACTT, which, when set to "1" in the FIG. 16 subroutine, indicates that a predetermined time period (delay time) has elapsed after inversion of the O2 sensor output SVO2 from the learner side to the richer side or vice versa, assumes "1". If FKACTT=0 holds at the step S529, i.e. if the predetermined time has not yet elapsed after inversion of the O2 sensor output SVO2, it is determined at a step S530 whether or not the count of the downcount timer tmLFSTM set at the step S526 or at a step S532, referred to hereinafter, is equal to "0". If tmLFSTM>0 holds at the step S530, i.e. if the predetermined time period TLFSTM has not elapsed, the present program is immediately terminated, whereas if tmLFSTM=0 holds at the step S530, the SVO2 monitoring flag FSVO2LAF is set to "1" at a step S531, followed by terminating the program.

If FKACTT=1 holds at the step S529, i.e. if the predetermined time has elapsed after inversion of the O2 sensor output SVO2 from the richer side to the learner side or vice versa, the downcount timer tmLFSTM is set to the predetermined time period TLFSTM and started at a step S532, and then it is determined at a step S533 whether or not the count NKACT of an NKACT counter is equal to "0". When this step is first executed, NKACT=0 holds, so that the program jumps to a step S535, wherein the count NKACT of the NKACT counter is incremented by "1". Then, it is determined at a step S536 whether or not the count NKACT of the NKACT counter is smaller than a predetermined value NKACTC (e.g. 5). When this step is first executed, NKACT<NKACTC holds, so that the present program is immediately terminated.

When the O2 sensor output SVO2 is inverted next time, the answer to the question of the step S533 is negative (NO), so that the program proceeds to a step S534, wherein a cumulative value KACTT of the actual equivalent ratio KACT is calculated by the use of the following equation (9), followed by the program proceeding to the step S535:

$$KACTT=KACTT+KACT \quad (9)$$

When the number of times of inversion of the actual equivalent ratio KACT reaches the predetermined value MKACTC, i.e. when NKACT=NKACTC holds at the step S536, the program proceeds to a step S537, wherein the average value KACTAV of the actual equivalent ratio KACT is calculated by the use of the following equation (10):

$$KACTAV=KACTT/(NKACT-1) \quad (10)$$

Figures 13A, 13B, 13C:
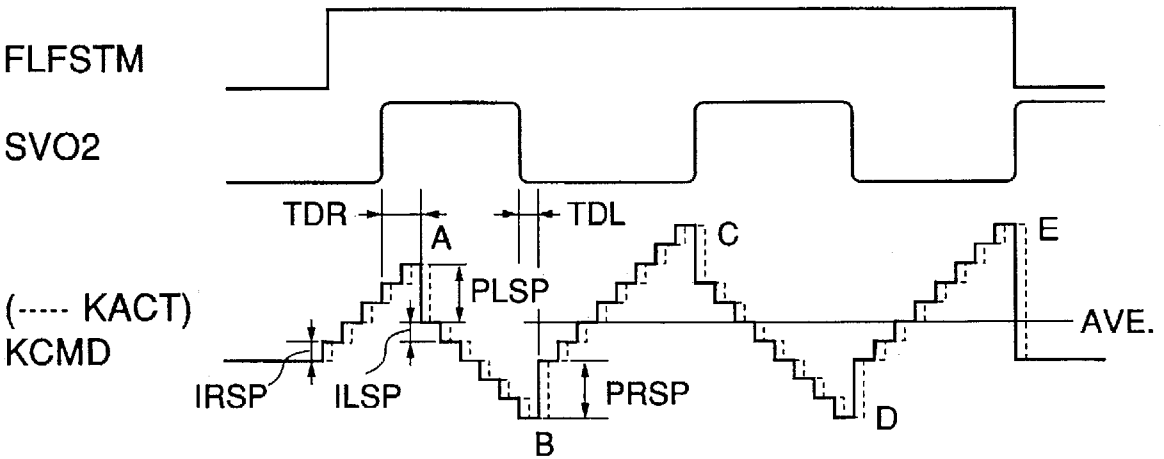

Thus, the average value KACTAV is obtained as an average value of KACT values obtained at time points B, C, D, and E appearing in FIG. 13C.

As shown in FIG. 13C, the average value of KACT values assumed at the time points of inversion thereof B, C, D, and E, exclusive of the time point of the first inversion A after starting the stoichiometric output deterioration determination, is calculated. This makes it possible to enhance the accuracy of the stoichiometric output deterioration determination. It should be noted that there is a possibility of the air-fuel ratio control being not sufficiently stabilized at the time point A, and hence the value obtained at the time point A can undesirably increase an error in calculation of the average value KACTAV.

At the following steps S538 and S539, it is determined whether or not the KACTAV value is larger than a predetermined lower limit value KACTAVL, and whether or not the same is smaller than a predetermined higher limit value KACTAVH, respectively. If KACTAVL<KACTAV<KACTAVH holds, it is determined that the LAF sensor is not deteriorated in respect of the stoichiometric output, and the stoichiometric output deterioration flag FLFSTNG remains set to "0".

Figure 15:
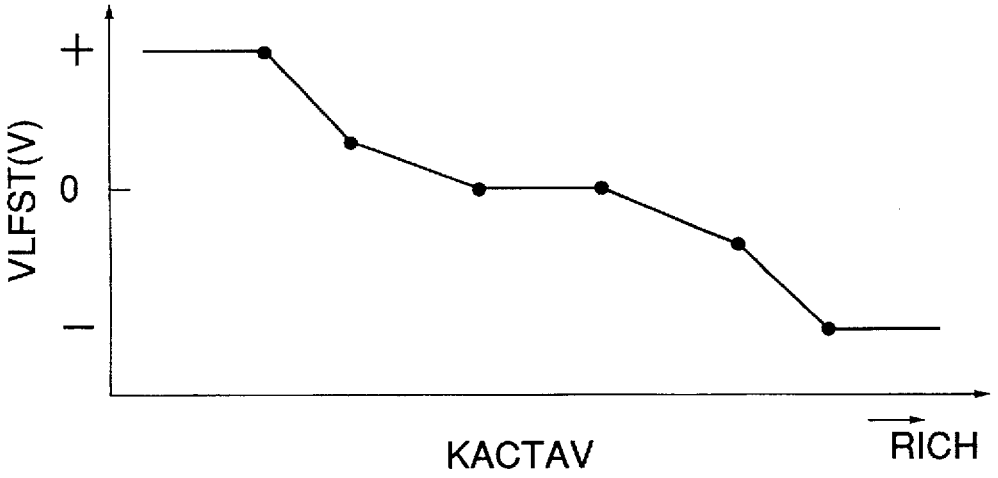
FIG. 15 shows a VLFST table.

Then, at a step S539A, the deviation amount LVFST of the LAF sensor output from a proper value thereof corresponding to the average value KACTAV is calculated by retrieving a VLFST table shown in FIG. 15.

Then, the stoichiometric output deterioration determination termination flag FLFSTEND is set to "1" at a step S541, and the stoichiometric output deterioration determination flag FLFSTM is set to "0" at a step S541A, followed by terminating the program.

Further, if KACTAV≦KACTAVL holds at the step S538 or KACTAV≧KACTAVH holds at the step S539, it is determined that the LAF sensor 17 suffers from the stoichiometric output deterioration, so that the stoichiometric output deterioration flag FLFSTNG is set to "1" at a step S540, followed by the program proceeding to the step S539A. Thus, the stoichiometric output deterioration of the LAF sensor 17, i.e. deviation of the LAF sensor output from the predetermined value is determined.

FIG. 16 shows a subroutine for executing the step S527 in FIG. 11 for calculating the desired equivalent ratio KCMD during the stoichiometric output deterioration determination.

First, at a step S801, it is determined whether or not the O2 sensor output SVO2 is higher than a predetermined reference value SVREF corresponding to a stoichiometric air-fuel ratio. If SVO2>SVREF holds, which means that the output from the O2 sensor indicates an air-fuel ratio richer than the stoichiometric air-fuel ratio, a first rich flag FAFR1 is set to "1" at a step S803, whereas if SVO2≦SVREF holds, which means that the output from the O2 sensor indicates an air-fuel ratio leaner than the stoichiometric air-fuel ratio, the flag FAFR1 is set to "0" at a step S802, followed by the program proceeding to a step S804.

At the step S804, it is determined whether or nor the first rich flag FAFR1 has been inverted, i.e. whether or not the O2 sensor output SVO2 has been inverted from the richer side to the leaner side or vice versa. If the first rich flag FAFR1 has not been inverted, the program jumps to a step S808, whereas if the same has been inverted, it is determined at a step S805 whether or not the first rich flag FAFR1 assumes "1". If FAFR1=1 holds at the step S805, i.e. if the O2 sensor output SVO2 is on the richer side, a downcount timer tmDLYR is set to a predetermined rich-side time period TRD and started at a step S807 to measure a time period elapsed after inversion of the first rich flag FAFR1, whereas if FAFR1=0 holds at the step S805, the downcount timer tmDLYR is set to a predetermined lean-side time period TLD at a step S806, followed by the program proceeding to a step S808.

At the step S808, it is determined whether or not the stoichiometric output deterioration determination execution flag FLFSTM assumes "1". If FLFSTM=0 holds, and hence the stoichiometric output deterioration determination is started in this loop, the cumulative value KACTT of the actual equivalent ratio KACT and the count NKACT of the counter NKACT to be incremented at the step S535 in FIG. 12 are both set to "0" at a step S809. Then, a second rich flag FAFR2 is set to a value equal to the first rich flag FAFR1, and the desired equivalent ratio KCMD is set to a predetermined value KCMCHK (e.g. 1.0) at a step S810, followed by the program proceeding to a step S813.

At the step S813, the inversion flag FKACTT is set to "0", and then it is determined at a step S814 whether or not the second rich flag FAFR2 assumes "0". If FAFR2=0 holds at the step S814, a rich-side integral term IRSP is added to the desired equivalent ratio KCMD at a step S815, whereas if FAFR2=1 holds at the same step, a lean-side integral term ILSP is subtracted from the KCMD value at a step S816, followed by the program proceeding to a step S822.

If FLFSTM=1 holds at the step S808, i.e. the stoichiometric output deterioration determination is being executed, the program proceeds to a step S811, wherein it is determined whether or not the first rich flag FAFR1 and the second rich flag FAFR2 are equal to each other. If FAFR1=FAFR2 holds at the step S811, the program proceeds to the step S813, whereas if FAFR1≠FAFR2 holds at the step S811, it is determined at a step S812 whether or not the count of the downcount timer tmDLYR started at the step S806 or S807 is equal to "0". Immediately after inversion of the first rich flag FAFR1, tmDLYR>0 holds, and hence the program proceeds to the step S813, and when the delay time TR or TL has elapsed so that tmDYLR=0 holds at the step S812, the second rich flag FAFR2 is made equal to the first rich flag FAFR1 at a step S817, and then the inversion flag FKACTT is set to "1" at a step S818.

At the following step S819, it is determined whether or not the first rich flag FAFR1 assumes "1". If FAFR1=0 holds, a rich-side proportional term PRSP is added to the desired equivalent ratio KCMD at a step S820, whereas if FAFR1=1 holds, a lean-side proportional term PLSP is subtracted from the KCMD value at a step S821, followed by the program proceeding to a step S822.

At the step S822, limit-checking of the KCMD value is executed, followed by terminating the program.

Thus, the desired equivalent ratio KCMD is calculated by PI control by the use of the proportional and integral terms alone in response to the O2 sensor output.

Figure 17:
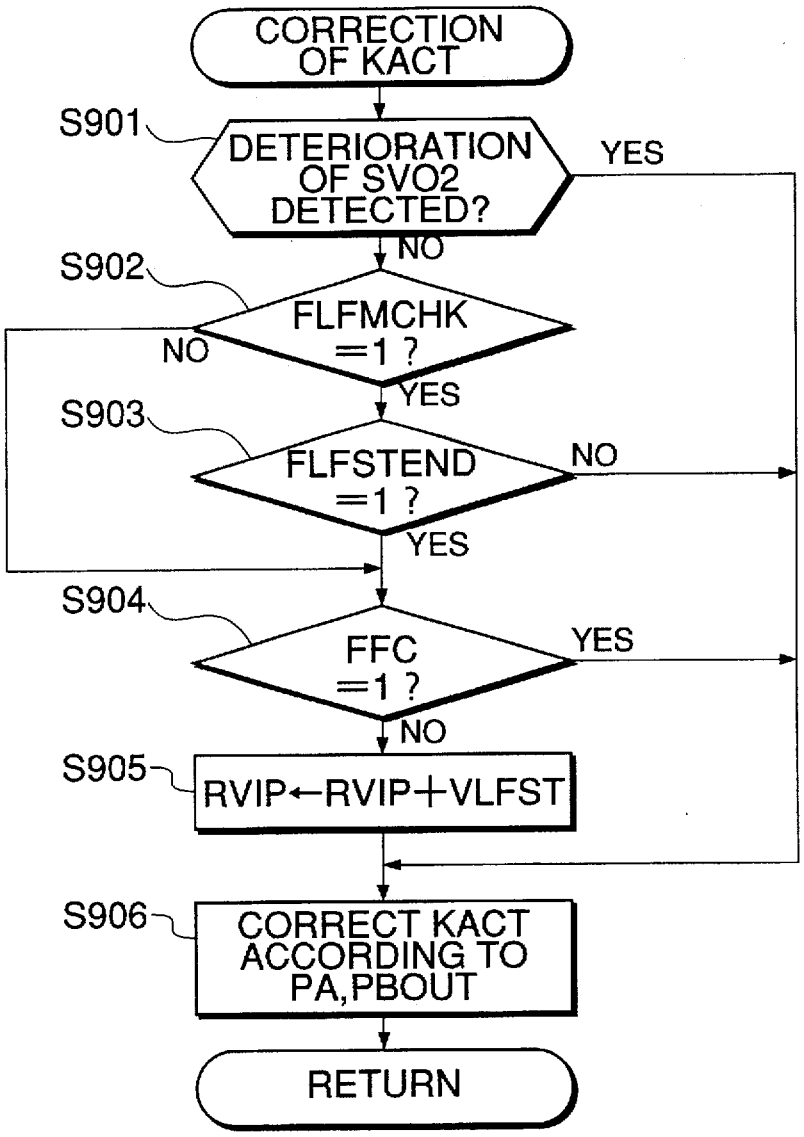
FIG. 17 is a flowchart showing a routine for correcting the actual equivalent ratio KACT.

Next, a routine for correcting the actual equivalent ratio KACT based on the LAF sensor output will be described with reference to FIG. 17.

First, it is determined at a step S901 whether or not the deterioration of the O2 sensor 18 has been detected. If the deterioration of the O2 sensor 18 has been detected, the program proceeds to a step S906, whereas if the O2 sensor has not been deteriorated, it is determined at a step S902 whether or not the monitoring condition flag FLFMCHK assumes "1". If FLMCHK=1 holds, which means that the conditions for permitting the response deterioration determination and the stoichiometric output determination of the LAF sensor 17 are fulfilled (i.e. the engine is in a LAF-monitoring region), it is determined at a step S903 whether or not the stoichiometric output deterioration determination termination flag FLFSTEND assumes "1". If FLFSTEND=0 holds at the step S903, the program proceeds to the step S906.

If FLMCHK=0 holds at the step S902 or if FLFSTEND=1 holds at the step S903, it is determined at a step S904 whether or not a fuel cut flag FFC, which, when set to "1", indicates that fuel cut or interruption of the fuel supply to the engine is being carried out, assumes "1". If FFC=1 holds, which means that fuel cut is being carried out, the program proceeds to the step S906, whereas if FFC=0 holds, the program proceeds to a step S905.

At the step S905, the deviation amount VLFST calculated at the step S539A in FIG. 12 is added to the LAF sensor output RVIP to correct the same. Then, at the step S906, the corrected RVIP value is further corrected according to the atmospheric pressure PA and exhaust gas pressure (pressure of exhaust gases in the exhaust pipe 16) PBOUT which is determined by retrieving a map according to the intake pipe absolute pressure PBA and the engine rotational speed NE, to calculate the actual equivalent ratio KACT, followed by terminating the program.

As described above, the air-fuel ratio control system according to the present embodiment is capable of detecting deterioration in the stoichiometric output of the LAF sensor 17 (upstream oxygen concentration sensor) by controlling the desired air-fuel ratio desired equivalent ratio) in response to the output from the O2 sensor 18 (downstream oxygen concentration sensor), calculating the average value KACTAV of the actual equivalent ratio KACT, which corresponds to the average value of the LAF sensor output, and determining that the LAF sensor 17 suffers from the stoichiometric output deterioration when the average value KACTAV falls outside a predetermined range.

Further, in the present embodiment, the LAF sensor output RVIP is corrected by the use of the deviation amount VLFST from the stoichiometric air-fuel ratio, which corresponds to the average value KACTAV of the actual equivalent ratio KACT, whereby the air-fuel ratio of the mixture supplied to the engine can be properly controlled to the stoichiometric air-fuel ratio to thereby secure the maximum purifying efficiency of the three-way catalysts 19, 20.

Next, a third embodiment will be described with reference to FIGS. 18 to 22.

The air-fuel ratio control system according to the present embodiment is also identical in arrangement with the whole arrangement of the first embodiment shown in FIG. 1. Component elements and parts of the engine and the system corresponding to those of the first embodiment are designated by identical reference numerals, and description thereof is omitted. The FIG. 2 main routine for calculating the PID correction coefficient KLAF, and the FIG. 6 main routine for determining the LAF sensor deterioration are also used in the present embodiment, similarly to the second embodiment. However, determination as to whether or not monitoring conditions for permitting determination of the lean output deterioration of the LAF sensor 17 are fulfilled is executed by a routine shown in FIG. 22.

The present embodiment is characterized by the manner of determining the lean output deterioration of the LAF sensor 17, which will be described in detail hereinbelow.

In the present embodiment, the fuel injection period TOUT is calculated by the use of the equation (2) referred to hereinbefore with respect to the second embodiment.

Figures 20A, 20B, 20C:
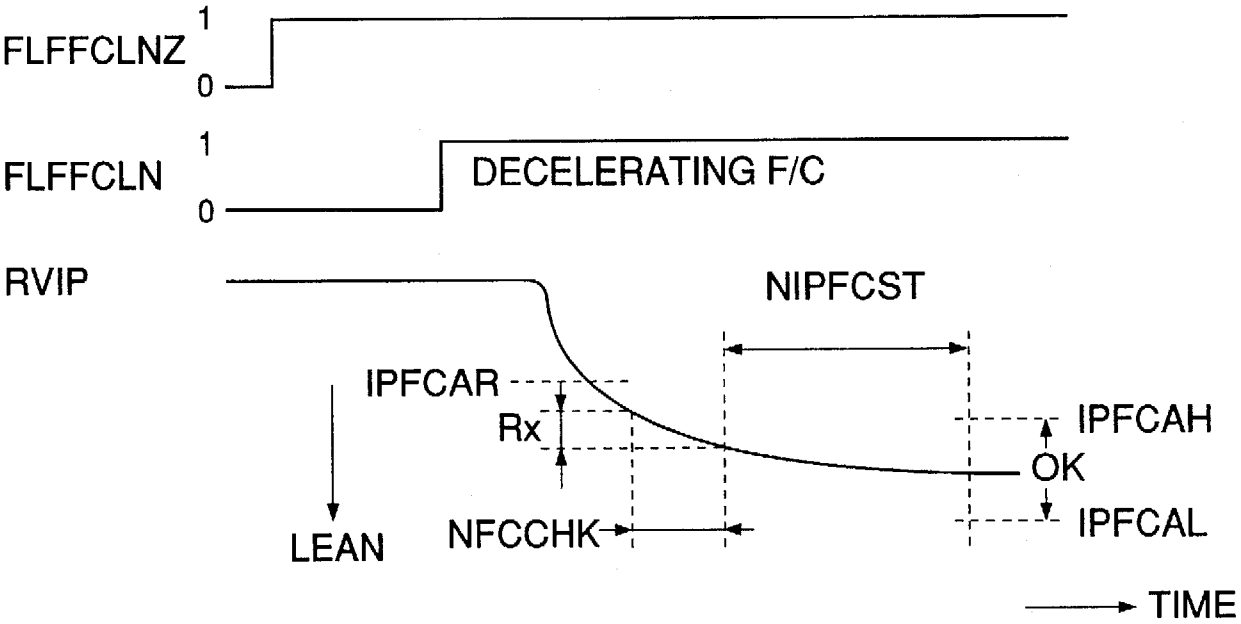

The manner of determining the lean output deterioration determination of the LAF sensor 17 will be described with reference to FIGS. 20A to 20C. When decelerating fuel cut (i.e. interruption of supply of fuel to the engine during deceleration) is started in a lean output deterioration-determining region (i.e., when a lean output deterioration-determining region flag FLFFCLNZ, referred to hereinafter, assumes "1"), a lean output deterioration determination-enabling flag FLFFCLNZ is set to "1" to indicate that conditions for executing the lean output deterioration determination are fulfilled. In this state, when the LAF sensor output RVIP became equal to or lower than a predetermined value IPFCAR, and a predetermined time period NIPFCST has elapsed after a rate of change |Rx| in the LAF sensor output RVIP over a predetermined time period NFCCHK became equal to or smaller than a predetermined value IPFCST (i.e. |Rx|≦IPFCST), it is determined whether or not an average value RVIPM of the LAF sensor output falls within a predetermined range defined by predetermined upper and lower limit values IPFCAH and IPFCAL. If the average value RVIPM does not fall within the predetermined range, it is determined that the LAF sensor 17 suffers from the lean output deterioration. Thus, in determining the lean output deterioration of the LAF sensor 17, the output from the LAF sensor 17 is checked after the LAF sensor output becomes fully stabilized, thereby making it possible to enhance the accuracy of the determination.

Figure 18:
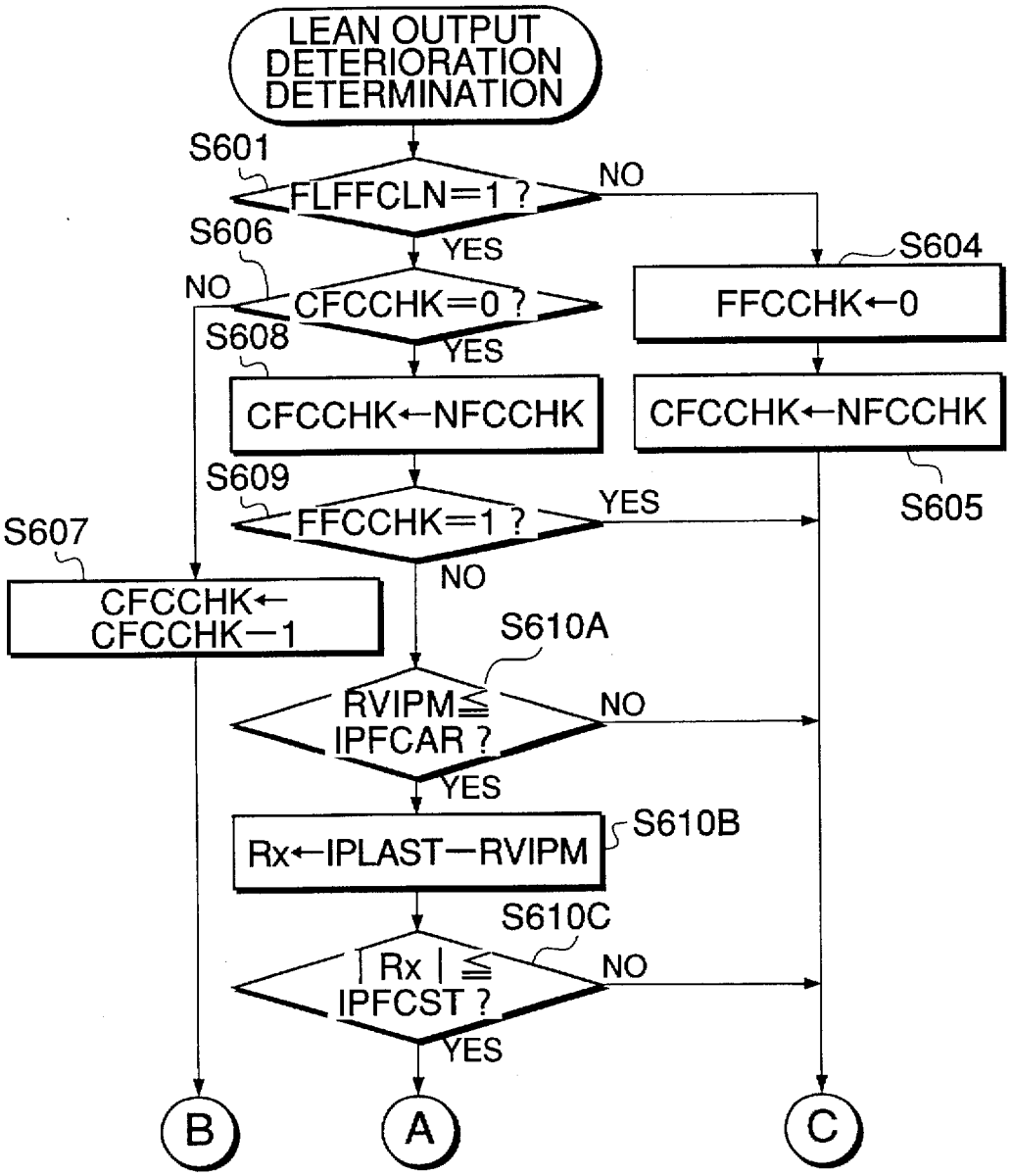
FIG. 18 is a flowchart showing a subroutine for determining deterioration of a lean output characteristic (lean output deterioration) of the LAF sensor, which is executed at a step S504 in FIG. 6, by an air-fuel ratio control system according to a third embodiment of the invention.
Figure 19:
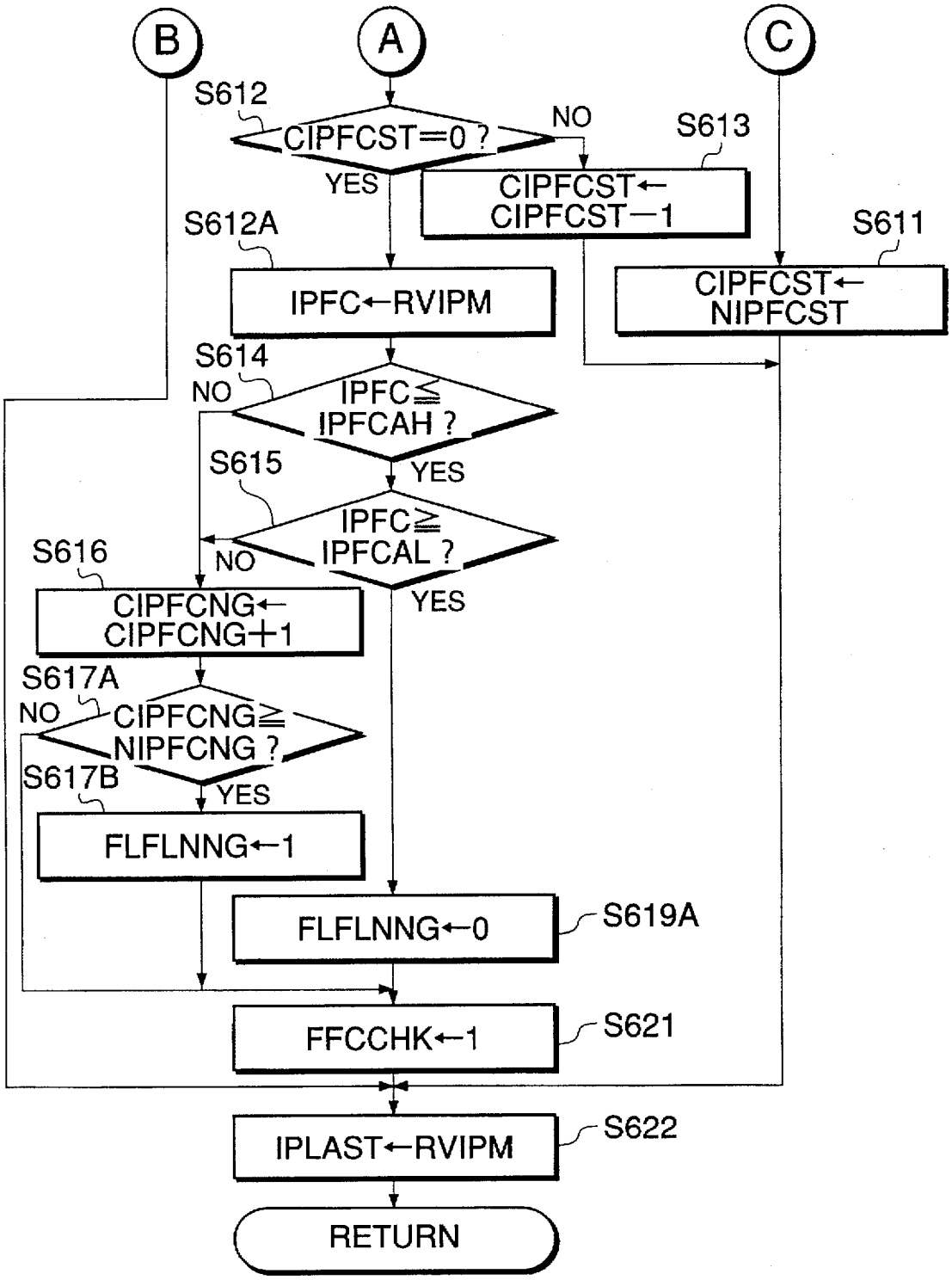
FIG. 19 is a continued part of the FIG. 18 flowchart.

FIGS. 18 and 19 show a subroutine for determining the lean output deterioration of the LAF sensor, which is executed at the step S504 in FIG. 6.

First, at a step S601, it is determined whether or not the lean output deterioration determination-enabling flag FLFFCLN assumes "1", which is set to "1" by executing a subroutine shown in FIG. 22, referred to hereinafter, to indicate that the monitoring conditions for the lean output deterioration determination are fulfilled. If FLFFCLN=0 holds, which means that the monitoring conditions are not fulfilled, a check flag FFCCHK, which, when set to "1", indicates that the determination as to whether the LAF sensor output RVIP falls within a range defined by predetermined upper and lower limit values has been completed, is set to "0" at a step S604, followed by the program proceeding to a step S605.

At the step S605, a CFCCHK check counter for setting a repetition period of monitoring the RVIP value is set to a predetermined value NFCCHK (e.g. 50), and then a CIPFCST stabilizing time period counter for measuring a stabilizing time period (delay time) after the rate of change in the RVIP value comes to fall within a predetermined range is set to a predetermined value NIPFCST at a step S611, followed by the program proceeding to a step S622.

If FLFFCLN=1 holds at the step S601, which means that the monitoring conditions are fulfilled, it is determined at a step S606 whether or not the count CFCCHK of the CFCCHK check counter set at the step S605 is equal to "0". When this step is first executed, CFCCHK>0 holds, so that the count CFCCHK of the CFCCHK check counter is decremented by "1" at a step S607, and then the program proceeds to the step S622. If CFCCHK=0 holds at the step S606, the program proceeds to a step S608, wherein the CFCCHK check counter is set to the predetermined time period NFCCHK again.

Then, it is determined at a step S609 whether or not a check flag FFCCHK, which, when set to "1", indicates that the execution of the lean output deterioration determination has been terminated assumes "1". If FFCCHK=0 holds, it is determined at a step S610A whether or not the average value RVIPM of the LAF sensor output RVIP (hereinafter referred to as "the output RVIPM") is equal to or smaller than a predetermined value IPFCAR.

If RVIPM>IPFCAR holds at the step S610A or if FFCCHK=1 holds at the step S609, the program proceeds to the step S611 without executing monitoring of the RVIPM value, whereas if RVIPM≦IPFCAR holds at the step S610A, the difference Rx between the present RVIPM value and the immediately preceding value IPLAST of the output RVIPM is calculated at a step S610B, and then it is determined at a step S610C whether or not the absolute value of the difference Rx is within a predetermined value (allowable variation range) IPFCST, which means that the LAF sensor output RVIPM is stable. If the absolute value of the difference Rx exceeds the predetermined value IPFCST, the program proceeds to the step S611.

If the absolute value of the difference Rx is equal to or smaller than the predetermined value IPFCST, which means that the range of variation of the output RVIPM is small, it is determined at a step S612 whether or not the count CIPFCST of the CIPFCST stabilizing time period counter set at the step S611 is equal to "0". When this step is first executed, CIPFCST>0 holds, so that the program proceeds to a step S613, wherein the count CIPFCST of the CIPFCST stabilizing time period counter is decremented by "1", and then the program proceeds to the step S622. If CIPFCST=0 holds at the step S612 in a subsequent loop, the present output value RVIPM is set to a variable IPFC at a step S612A, and it is determined at steps S614 and S615 whether or not the IPFC value falls within the aforementioned predetermined range defined by the predetermined upper and lower limit values IPFCAH and IPFCAL. If IPFC>IPFCAH or IPFC<IPFCAL holds, which means that the IPFC value is outside the predetermined range, the count CIPFCNG of an NG counter is incremented by "1" at a step S616, and then it is determined at a step S617A whether or not the count CIPFCNG of the NG counter is equal to or larger than a predetermined value NIPFCNG (e.g. two) for one continuous operation of the engine. If CIPFCNG<NIPFCNG holds, the program jumps to a step S621, whereas if CIPFCNG≧NIPFCNG holds, it is judged that the LAF sensor 17 suffers from the lean output deterioration, and the program proceeds to a step S617B, wherein the lean output deterioration flag FLFLNNG is set to "1", followed by the program proceeding to the step S621.

Figure 21:
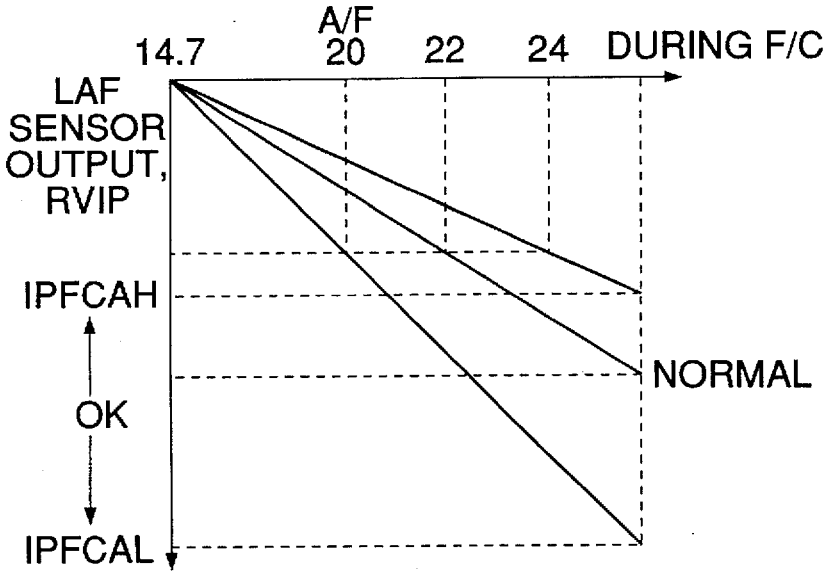
FIG. 21 is a graph which is useful in explaining a normal range of the LAF sensor output RVIP.

FIG. 21 shows a range of the LAF sensor output RVIP, within which the LAF sensor output RVIP is determined to be normal. As shown in the figure, when the output from the LAF sensor 17 during decelerating fuel cut of the engine is within the tolerance range defined by the predetermined upper and lower limit values IPFCAH and IPFCAL, it is determined that the LAF sensor output RVIP is normal.

On the other hand, if as a result of the determinations at the steps S614 and S615, IPFCAL≦IPFC≦IPFCAH holds, which means that the RVIP value is within the predetermined tolerance range, the program proceeds to a step S619A, wherein the lean output deterioration flag FLFLNNG is set to "0". Then, at the step S621, the check flag FFCCHK is set to "1", followed by the program proceeding to the step S622.

At the step S622, the present value of the output RVIPM is set to the immediately preceding value IPLAST thereof, followed by terminating the program.

As described above, the air-fuel ratio control system according to the present embodiment determines the lean output deterioration of the LAF sensor 17 by determining, during decelerating fuel cut of the engine, whether or not the average value (output RVIPM) of the LAF sensor output RVIP falls within the predetermined normal tolerance range defined by the predetermined upper and lower limit values IPFCAH and IPFCAL when the predetermined time period NIPFCST has elapsed after the rate of change in the LAF sensor output RVIP became smaller than the predetermined value IPFCST with the LAF sensor output RVIP being equal to or lower than the predetermined value IPFCAR. Therefore, the lean output deterioration determination is made when the LAF sensor output is fully stabilized, thereby enhancing the accuracy of the determination.

FIG. 22 shows the subroutine for determining whether the monitoring conditions, i.e. the conditions for carrying out the lean output deterioration determination are fulfilled, which is executed as background processing.

First, at a step S641, it is determined whether or not the engine is in the starting mode. If the engine is in the starting mode, a delay time period (e.g. 0.1 sec.) is set to a downcount timer tmLFFC at a step S641A, and the aforementioned lean output deterioration-determining region flag FLFFCLNZ, which, when set to "1", indicates that the engine and the vehicle are in a lean output deterioration-determining region suitable for the lean output deterioration determination of the LAF sensor, is set to "0" at a step S649. Further, a delay time period (e.g. 0.1 sec.) is set to a downcount timer tmF61 at a step S651A, and the lean output deterioration determination-enabling flag FLFFCLN is set to "0" at a step S653, followed by terminating the program.

If the engine is not in the starting mode, it is determined at a step S642 whether or not the LAF sensor 17 has been activated. If the LAF sensor 17 has not been activated, the program proceeds to the step S641A, whereas if the same has been activated, it is determined at a step S643 whether or not a decelerating fuel-cut flag FDECFC, which, when set to "1", indicates that the engine is in a decelerating fuel-cut condition in which the engine is decelerating and at the same time fuel cut is being carried out, is equal to "1".

If FDECFC=0 holds, i.e. if the engine is not in the decelerating fuel-cut condition, it is determined at a step S643A whether or not evaporative fuel has been purged by the evaporative emission control system in a predetermined amount or more. If the evaporative fuel has not been purged by the evaporative emission control system 40 in the predetermined amount or more, the air-fuel ratio of exhaust gases can largely deviate from the desired value under the influence of purged evaporative fuel, so that the program proceeds to the step S649, whereas if the evaporative fuel has been purged in the predetermined amount or more, it is determined at a step S644 whether or not the engine coolant temperature TW is lower than a predetermined value TWLFFC. If TW≧TWLFFC holds, it is determined at a step S645 whether or not the intake air temperature TA is higher than a predetermined value TALFFCH. If TA≦TALFFCH holds, it is determined at a step S645A whether or not the intake air temperature TA is lower than a predetermined temperature value TALFFCL. If TA≧TALFFCL holds, it is determined at steps S646 and 647 whether or not the vehicle speed V is within a range defined by predetermined upper and lower limit values VLFFCH and VLFFCL. If VLFFCL≦V≦VLFFCH holds, it is determined at a step S648 whether or not the engine rotational speed NE is higher than a predetermined value NLFFCH. If NE≦NLFFCH holds, it is determined at a step S648A whether or not the count tmLFFC of the downcount timer tmLFFC is equal to "0".

If any of the answers to the questions of the step S644 to S648 is affirmative (YES) or if the answer to the question of the step S648A is negative (NO), it is judged that the engine and the vehicle are not in the lean output deterioration-determining region, so that the program proceeds to the step S649, whereas if all the answers to the questions of the steps S644 to S648 are negative (NO) and at the same time the answer to the question of the step S648A is affirmative (YES), it is judged that the engine and the vehicle are in the lean output deterioration-determining region, so that the lean output deterioration-determining region flag FLFFCLNZ is set to "1" at a step S650, and the program proceeds to the step S651A.

If FDECFC=1 holds at the step S643 thereafter, which means that the engine is in the decelerating fuel-cut condition, it is determined at a step S643B whether or not the count tmFC61 of the downcount timer tmFC61 is equal to "0". If tmFC61=0 holds, the delay time period is set to the downcount timer tmLFFC at a step S643C, and then the program proceeds to a step S651, whereas if tmFC61≠0 holds, the program jumps to the step S651, wherein it is determined whether or not the lean output deterioration-determining region flag FLFFCLNZ assumes "1". If FLFFCLNZ=0 holds, i.e. if the engine was not in the lean output deterioration-determining region immediately before the engine has entered the decelerating fuel-cut condition, the program proceeds to the step S653, thereby inhibiting the lean output deterioration determination, whereas if FLFFCLNZ=1 holds at the step S651, the lean output deterioration determination-enabling flag FLFFCLN is set to "1" at a step S652, thereby permitting the lean output deterioration determination.

As described above by executing the FIG. 22 subroutine, the lean output deterioration determination is permitted when the engine enters the decelerating fuel-cut condition from the lean output deterioration-determining region in which the lean output deterioration-determining region flag FLFFCLNZ assumes "1".

What is claimed is:

1. An air-fuel ratio control system for an internal combustion engine having an exhaust passage, comprising:

air-fuel ratio-detecting means arranged in said exhaust passage, for generating an output proportional to concentration of oxygen in exhaust gases emitted from said engine;

air-fuel ratio feedback control means for controlling an air-fuel ratio of a mixture supplied to said engine to a desired air-fuel ratio in response to said output from said air-fuel ratio-detecting means by the use of a proportional term and an integral term;

inversion period-calculating means for calculating a repetition period of inversion of said output from said air-fuel ratio-detecting means with respect to a predetermined reference value; and deterioration-detecting means for detecting deterioration of said air-fuel ratio-detecting means, based on said repetition period of inversion of said output from said air-fuel ratio-detecting means calculated by said inversion period-calculating means.

2. An air-fuel ratio control system according to claim 1, wherein said predetermined reference value is provided with hysteresis.

3. An air-fuel ratio control system according to claim 1, wherein said air-fuel ratio feedback control means controls said air-fuel ratio of said mixture in a feedback manner responsive to said output from said air-fuel ratio-detecting means by the use of said proportional term, said integral term and a differential term, when said engine is outside a predetermined operating condition suitable for determination of deterioration of said air-fuel ratio-detecting means, and controls said air-fuel ratio of said mixture in a feedback manner responsive to said output from said air-fuel ratio-detecting means by the use of said proportional term and said integral term when said engine is in said predetermined operating condition suitable for determination of deterioration of said air-fuel ratio-detecting means.

4. An air-fuel ratio control system according to claim 1, wherein said deterioration-detecting means determines that said air-fuel ratio-detecting means is deteriorated in response characteristic when said repetition period of inversion exceeds a predetermined value.

5. In an air-fuel ratio control system for an internal combustion engine having an exhaust passage, said air-fuel ratio control system including a catalyst arranged in said exhaust passage, first air-fuel ratio-detecting means arranged in said exhaust passage at a location upstream of said catalyst, for generating an output proportional to concentration of oxygen in exhaust gases emitted from said engine, and second air-fuel ratio-detecting means arranged in said exhaust passage at a location downstream of said catalyst, for generating an output which assumes a lean value or a rich value with respect to a stoichiometric air-fuel ratio according to an air-fuel ratio of said exhaust gases, the improvement comprising:

desired air-fuel ratio-calculating means for calculating a desired air-fuel ratio by the use of a proportional term and an integral term in response to said output from said second air-fuel ratio-detecting means;

air-fuel ratio control means for controlling an air-fuel ratio of a mixture supplied to said engine to said desired air-fuel ratio calculated by said desired air-fuel ratio-calculating means in a feedback manner responsive to said output from said first air-fuel ratio-detecting means; and deterioration-detecting means for detecting deterioration of said first air-fuel ratio-detecting means, based on an average value of said output from said first air-fuel ratio-detecting means.

6. An air-fuel ratio control system according to claim 5, wherein said deterioration-detecting means includes average value-calculating means for calculating said average value of said output from said first air-fuel ratio-detecting means by averaging a predetermined number of values of said output from said first air-fuel ratio-detecting means consecutively generated whenever said output from said second air-fuel ratio control means is inverted with respect to said stoichiometric air-fuel ratio, said deterioration-detecting means determining that said first air-fuel ratio-detecting means is deteriorated when said average value is outside a predetermined value range.

7. An air-fuel ratio control system according to claim 5, including correcting means for correcting said output from said first air-fuel ratio-detecting means, based on said average value of said output from said first air-fuel ratio-detecting means.

8. An air-fuel ratio control system according to claim 6, including correcting means for correcting said output from said first air-fuel ratio-detecting means, based on said average value of said output from said first air-fuel ratio-detecting means.

9. An air-fuel ratio control system according to claim 8, wherein said correcting means determines a difference between said average value of said output from said first air-fuel ratio-detecting means and said stoichiometric air-fuel ratio and corrects said output from said first air-fuel ratio-detecting means, based on said difference.

10. An air-fuel ratio control system according to claim 5, wherein said desired air-fuel ratio-calculating means applies said integral term in calculating said desired air-fuel ratio such that said air-fuel ratio of said mixture is enriched when said output from said second air-fuel ratio-detecting means is on a leaner side with respect to said stoichiometric air-fuel ratio, and said air-fuel ratio of said mixture is leaned when said output from said second air-fuel ratio is on a richer side with respect to said stoichiometric air-fuel ratio.

11. An air-fuel ratio control system according to claim 5, wherein said air-fuel ratio control means controls said air-fuel ratio of said mixture in said feedback manner responsive to said output from said first air-fuel ratio-detecting means by the use of a proportional term, an integral term and a differential term.

12. In an air-fuel ratio control system for an internal combustion engine installed on an automotive vehicle and having an exhaust passage, said air-fuel ratio control system including air-fuel ratio-detecting means arranged in said exhaust passage for generating an output which is proportional to concentration of oxygen in exhaust gases emitted from said engine, and fuel amount control means for controlling an amount of fuel supplied to said engine, based on said output from said air-fuel ratio-detecting means, the improvement comprising:

fuel supply-interrupting means for interrupting supply of fuel to said engine when said automotive vehicle and said engine are in respective predetermined operating conditions; and deterioration-detecting means for detecting deterioration of said air-fuel ratio-detecting means, based on said output from said air-fuel ratio-detecting means when a variation in said output from said air-fuel ratio-detecting means falls within a predetermined range after said supply of fuel to said engine is interrupted.

13. An air-fuel ratio control system according to claim 12, wherein said deterioration-detecting means detects said deterioration of said air-fuel ratio-detecting means, based on an value of said output from said air-fuel ratio-detecting means obtained when a predetermined time period has elapsed after said variation in said output from said air-fuel ratio-detecting means falls within said predetermined range.

14. An air-fuel ratio control system according to claim 12, wherein said deterioration-detecting means detects said deterioration of said air-fuel ratio-detecting means, based on said output from said air-fuel ratio-detecting means when said output from said air-fuel ratio-detecting means falls below a predetermined value and at the same time said variation in said output from said air-fuel ratio-detecting means falls within said predetermined range, after said supply of fuel to said engine is interrupted.

15. An air-fuel ratio control system according to claim 12, including average value-calculating means for calculating an average value of said output from said air-fuel ratio-detecting means, and wherein said deterioration-detecting means determines that said air-fuel ratio-detecting means is deteriorated when said average value of said output from said air-fuel ratio-detecting means falls outside a predetermined range.

* * * * *